US006637212B2

(12) United States Patent
Torres, Jr. et al.

(10) Patent No.: US 6,637,212 B2
(45) Date of Patent: Oct. 28, 2003

(54) METHOD AND APPARATUS FOR THE DELIVERY OF LIQUEFIED GASES HAVING CONSTANT IMPURITY LEVELS

(75) Inventors: Robert Torres, Jr., Parker, CO (US); Joseph V. Vininski, Denver, CO (US); Joseph Giagnacova, Harleysville, PA (US); Belgin Yucelen, Boulder, CO (US)

(73) Assignee: Matheson Tri-Gas, Longmont, CO (US)

( * ) Notice: Subject to any disclaimer, the term of this patent is extended or adjusted under 35 U.S.C. 154(b) by 0 days.

(21) Appl. No.: 10/128,992

(22) Filed: Apr. 24, 2002

(65) Prior Publication Data

US 2003/0010040 A1 Jan. 16, 2003

Related U.S. Application Data

(60) Provisional application No. 60/287,034, filed on Apr. 27, 2001.

(51) Int. Cl.[7] ..... F17C 9/02
(52) U.S. Cl. ..... 62/50.2
(58) Field of Search ..... 62/50.2, 50.4, 62/50.5

(56) References Cited

U.S. PATENT DOCUMENTS

| | | | | | |
|---|---|---|---|---|---|
| 3,969,449 | A | | 7/1976 | Shires et al. | 261/153 |
| 4,200,496 | A | | 4/1980 | Stein | 202/153 |
| 4,255,646 | A | * | 3/1981 | Dragoy et al. | 392/396 |
| 4,464,904 | A | | 8/1984 | Steigman | 62/52 |
| 4,847,469 | A | | 7/1989 | Hofmann et al. | 219/273 |
| 4,991,449 | A | * | 2/1991 | Dieguez | 73/863.11 |
| 5,107,906 | A | | 4/1992 | Swenson et al. | 141/11 |
| 5,252,134 | A | | 10/1993 | Stauffer | 118/726 |
| 5,329,777 | A | * | 7/1994 | Weltmer, Jr. | 62/49.2 |
| 5,337,738 | A | | 8/1994 | Heinonen | 128/203.12 |
| 5,386,707 | A | * | 2/1995 | Schulte et al. | 62/50.2 |
| 5,644,921 | A | | 7/1997 | Chowdhury | 62/48.1 |
| 5,762,119 | A | | 6/1998 | Platz et al. | 141/231 |
| 5,803,165 | A | * | 9/1998 | Shikazono et al. | 165/184 |
| 5,882,416 | A | | 3/1999 | Van Buskirk et al. | 118/726 |
| 5,894,742 | A | * | 4/1999 | Friedt | 62/50.2 |
| 6,032,483 | A | | 3/2000 | Paganessi et al. | 62/620 |
| 6,096,134 | A | | 8/2000 | Zhao et al. | 118/715 |

* cited by examiner

*Primary Examiner*—William C. Doerrler
(74) *Attorney, Agent, or Firm*—Steven C. Petersen; Sarah O'Rourke; Hogan & Hartson LLP

(57) ABSTRACT

A method and an apparatus are provided for the delivery of a vapor phase product having a substantially constant impurity level from a liquefied source of said gas to an endpoint. The delivery method includes withdrawing a liquefied gas having a level of impurities from a storage container and delivering the liquefied gas to a vaporization unit where the liquefied gas and the impurities dissolved therein are completely vaporized. The vapor phase product is then delivered to an endpoint. This invention affords the delivery of gases with substantially constant impurity levels throughout the delivery of the liquefied gas. In addition, this invention affords the delivery of the liquefied gas at high vapor phase flow rates for long periods of time and allows substantially complete usage of the contents of the storage container.

34 Claims, 14 Drawing Sheets

METHOD AND APPARATUS FOR THE DELIVERY OF LIQUEFIED GASES HAVING CONSTANT IMPURITY LEVELS

CROSS-REFERENCE TO RELATED APPLICATIONS

This application claims priority to U.S. Provisional Application Ser. No. 60/287,034, filed Apr. 27, 2001, and entitled "Method and Apparatus for the Delivery of Liquid Gases Having a Constant Impurity," which is incorporated herein by reference in its entirety.

BACKGROUND OF THE INVENTION

1. Field of the Invention

This invention relates to an apparatus and process for delivering a vapor phase product having a constant impurity level from a liquefied gas source to an end point. More specifically, this invention relates to an apparatus and process that delivers a liquefied gas having a level of soluble impurities from a storage container to a vaporization unit external from the storage container, whereupon the liquefied gas and the soluble impurities are completely converted to the vapor phase having a substantially equivalent (i.e., constant) concentration of said impurities as in the liquefied gas, thereby preventing the build-up of such impurities in the storage container or in the vaporization unit. The vapor phase product is then directed to a point of use such as a semiconductor fabrication tool.

2. Description of the State of Art

Electronic specialty gases (ESG's) play an important role in the production of integrated circuits. Examples of such specialty gases include ammonia ($NH_3$), hydrogen chloride (HCl), hydrogen bromide (HBr), chlorine ($Cl_2$), tungsten hexafluoride ($WF_6$), hydrogen fluoride (HF), carbon dioxide ($CO_2$), nitrous oxide ($N_2O$), dicholorosilane ($SiH_2Cl_2$), phosphine ($PH_3$), arsine ($AsH_3$), silane ($SiH_4$), disilane ($Si_2H_6$), chlorine trifluoride ($ClF_3$), and boron trichloride ($BCl_3$). Additional ESG's include, for example, the class of materials known as perfluorocarbons (PFC's). Processes for the production of integrated circuits using such gases include chemical vapor deposition (CVD), diffusion, reactive ion etching (RIE), plasma and thermal etching of silicon and gallium arsenide wafer surfaces, deposition of silicon nitride layers, metal organic chemical vapor deposition (MOCVD) and growth of gallium nitride films in light emitting diodes (LED's). Moisture or any other impurities in the electronic specialty gases can adversely affect the performance of all these processes. These impurities can be carried to the semiconductor fabrication tools used in these processes and consequently have a direct impact on the wafer yield.

Typically, these electronic specialty gases are stored in a storage container as compressed gases in the liquid phase under their own vapor pressure, and are used in a semiconductor fabrication tool in the vapor phase. Currently, conventional gas delivery systems require the gas to be vaporized directly within the storage container and then delivered throughout the gas distribution system. However, conventional gas phase delivery systems possess many problems due to the inability to maintain constant flow for long periods of time. Additionally, gasses delivered from conventional gas delivery systems have inconsistent impurity concentrations. The build-up of impurities within conventional gas delivery systems causes severe fluctuations in the impurity concentrations as a function of time, temperature, pressure and flow rate. These fluctuations may influence the process performance, and the build-up of impurities may reduce the amount of product usage. Furthermore, it is impossible to have a specification for a certain impurity on a fall storage container, since the concentrations of impurities change as the container is consumed.

Conventional gas delivery systems using cylinders also require frequent cylinder changes and multiple connections, which increase the probability of impurity build-up within the container, decrease the lifetime of gas manifolds, and increase the chance for accidents. Delivery systems which do not require frequent cylinder changes and which are capable of high flow rates greater than 5000 standard liters per minute will soon be required by the semiconductor industry because of the transition to larger fabrications along with introduction of 300 mm wafers. Furthermore, conventional gas delivery systems can cause the formation of liquid droplets that are entrained in the gas flowing through the gas delivery system. These entrained droplets contain contaminants that increase corrosion and lead to the failure of downstream components such as regulators, valves, mass flow controllers, and pressure transducers. Moisture in corrosive gases can farther lead to metallic particulate contamination within the gas distribution system, which has a direct impact on the wafer yield.

U.S. Pat. No. 5,644,921 discloses an apparatus for storing ultra-high purity non-cryogenic liquefied compressed gases and a method for delivering a vaporized gaseous product produced from the liquefied gas for semiconductor process applications. The delivery method includes withdrawing and heating a gaseous product from a storage vessel containing the liquefied compressed gas, then piping the heated gas through the liquid contained in the storage vessel in a heat exchange fashion.

U.S. Pat. No. 6,032,438 describes a method and a system for the delivery of a vapor phase product to a point of use and an on-site chemical distribution system and method. The system includes a storage vessel containing a liquid chemical under its own vapor pressure, a column connected to receive the chemical in a liquefied state from the storage vessel where the chemical is fractionated into a contaminated liquid heavy fraction and a purified light vapor fraction, and a conduit connected to the column for removing the purified light vapor fraction therefrom. This system requires that the residual contaminated liquid be periodically drained.

U.S. Pat. No. 5,894,742 describes a method and system for delivering an ultra-high purity gas to a point of use. The method involves transporting an ultra-high purity pressurized liquid from a container to a phase change device (i.e., an evaporator) where the pressurized liquid-phase gas is converted into the gas phase, and delivering the gas to a point of use. The flow of liquid into the evaporator is controlled by sensors that maintain the liquid level in the evaporator to about 70% of total capacity. In this type of evaporator, the impurities dissolved in the liquid phase build up in the evaporator, similar to conventional gas phase delivery systems. The phase change device of this system does not allow for 100% vaporization since a pool of liquefied gas constantly resides in the evaporator. This system also requires the whole system, including the bulk container, the distribution conduits, and the evaporators to be totally emptied of its liquid content periodically. The entire system must then be carefully cleaned and purged before being refilled with fresh product. The purpose of this periodical maintenance is to discard the growingly impure liquid phase chemical from the system. Thus, the build up of the soluble impurities and subsequent elimination of a portion of the liquid phase chemical ultimately causes the consumer to discard 10–30% of the original amount of the liquid chemical.

Conventional vaporizers, which are used for the vaporization of liquefied gases in the semiconductor industry, may be classified as follows: (i) a heating medium separated from the evaporating liquid by tubular heating surfaces, (ii) a heating medium confined by coils, jackets, double walls, flat plates, etc., (iii) a heating medium brought into direct contact with evaporating liquid, and (iv) heating by solar radiation (see, Perry and Green, Chemical Engineer's Handbook, 1984). Delivery systems that allow the evaporating liquid to be stored in a storage tank, where the evaporating liquid is not effectively in contact with the heating medium, work by principles very similar to a conventional gas delivery system. The liquefied gas undergoes a single plate distillation within the vaporizing device and is only partially vaporized. Therefore, this kind of vaporizer causes the concentration of impurities to change with time. Conventional vaporizers, which are used for the vaporization of liquefied gases in the semiconductor industry, are of this kind, i.e., they only partially vaporize the liquefied gas. Therefore, with conventional vaporizers, it is difficult to deliver the gas with a constant concentration of impurities.

The semiconductor industry is currently requiring higher vapor phase flow rates with lower and more consistent impurity levels. However, conventional gas delivery systems cannot maintain sustained flow rates above 900 standard liters per minute (slpm). There is still a need, therefore, for a gas delivery system that is capable of maintaining constant impurity levels throughout the consumption of a storage container and is able to maintain high flow rates (e.g., greater than 1000 slpm) for long periods of time. There is also a need for a system that is able to deliver the entire contents of the storage container. Such a system would not only reduce the costs associated with the material and reduce the frequent replacement of the storage container, but also would avoid the extra costs related to the recovery or disposal procedures of the waste gas.

SUMMARY OF THE INVENTION

To meet the stringent requirements of the semiconductor industry and to overcome the problems of conventional gas delivery systems, this invention provides a unique system for the delivery of a gas, such as an electronic specialty gas, from a liquid source. The delivery system of this invention prevents the buildup of impurities, such as water or any other impurities dissolved in liquid phase of the stored gas, both within the storage container and the vaporization unit. The delivery system of this invention is therefore able to maintain substantially constant levels of the soluble impurities in the both the liquid phase and the vapor phase of the gas throughout the delivery process, thereby leading to constant yields in the production of end products utilizing gases from the gas delivery system of this invention.

Accordingly, one embodiment of this invention provides a delivery system for supplying a vapor phase product having substantially constant impurity levels from an initially liquefied form of a gas from at least one storage container to an endpoint, comprising:

a vaporization unit comprising an inlet, an outlet, a vaporizing means for converting a liquefied gas having a concentration of soluble impurities to the vapor phase, and a heating means for heating said vaporizing means to a temperature sufficient to completely vaporize said liquefied gas and said soluble impurities, wherein said vaporizing means is capable of completely vaporizing said liquefied gas and said soluble impurities to form a vapor phase product before said liquefied gas and said soluble impurities accumulate in said vaporization unit, wherein said vapor phase product has an impurity level that is substantially equivalent to the impurity level of said impurities in said liquefied gas;

a first delivery conduit for delivering said liquefied gas from said at least one storage container to said vaporization unit; and a second delivery conduit for delivering said vapor phase product from said vaporization unit to said endpoint.

By completely vaporizing all of the liquefied gas and the soluble impurities that enter the vaporization unit, a pool of liquid where the soluble impurities can build up does not accumulate in any component of the vaporization unit. Thus, the design of the delivery systems of this invention prevents buildup of the soluble impurities in both the liquefied gas source and the vaporization unit.

The delivery systems of this invention allow for use of substantially all of the contents of the storage container by ensuring that the concentration of soluble impurities within the storage container does not fluctuate throughout the consumption of contents of the container.

Further, the delivery systems of this invention maintain substantially constant impurity concentrations that are independent of the starting concentration of the impurities dissolved in the liquefied gas.

The delivery systems of this invention are also capable of maintaining high vapor phase flow rates for longer periods of time relative to conventional gas delivery systems. In addition, the delivery systems of this invention are also capable of maintaining constant impurity levels throughout the consumption of the contents of small containers (e.g., 10 milliliter bubblers) at low vapor phase flow rates for long periods of time. More specifically, the gas delivery systems of this invention are capable of maintaining constant impurity levels throughout the consumption of a storage container at vapor phase flow rates from about 0.001 standard liters per minute (slpm) to at least 10,000 slpm for long periods of time.

The delivery systems of this invention further allow the delivery of a vapor phase product to one or more endpoints without leading to the formation of liquid droplets which can cause fluctuations in impurity concentrations and/or increase corrosion and cause the failure of downstream components such as regulators, mass flow controllers, and pressure transducers.

Additional advantages and novel features of the invention shall be set forth in part in the description that follows, and in part will become apparent to those skilled in the art upon examination of the following specification or may be learned by the practice of the invention. The features and advantages of the invention may be realized and attained by means of the instrumentalities, combinations, and methods particularly pointed out in the appended claims.

BRIEF DESCRIPTION OF THE DRAWINGS

The accompanying drawings, which are incorporated in and form a part of the specification, illustrate certain embodiments of this invention, and together with the description serve to explain the principles of the invention.

In the Drawings.

DETAILED DESCRIPTION OF THE INVENTION

Figure 1:
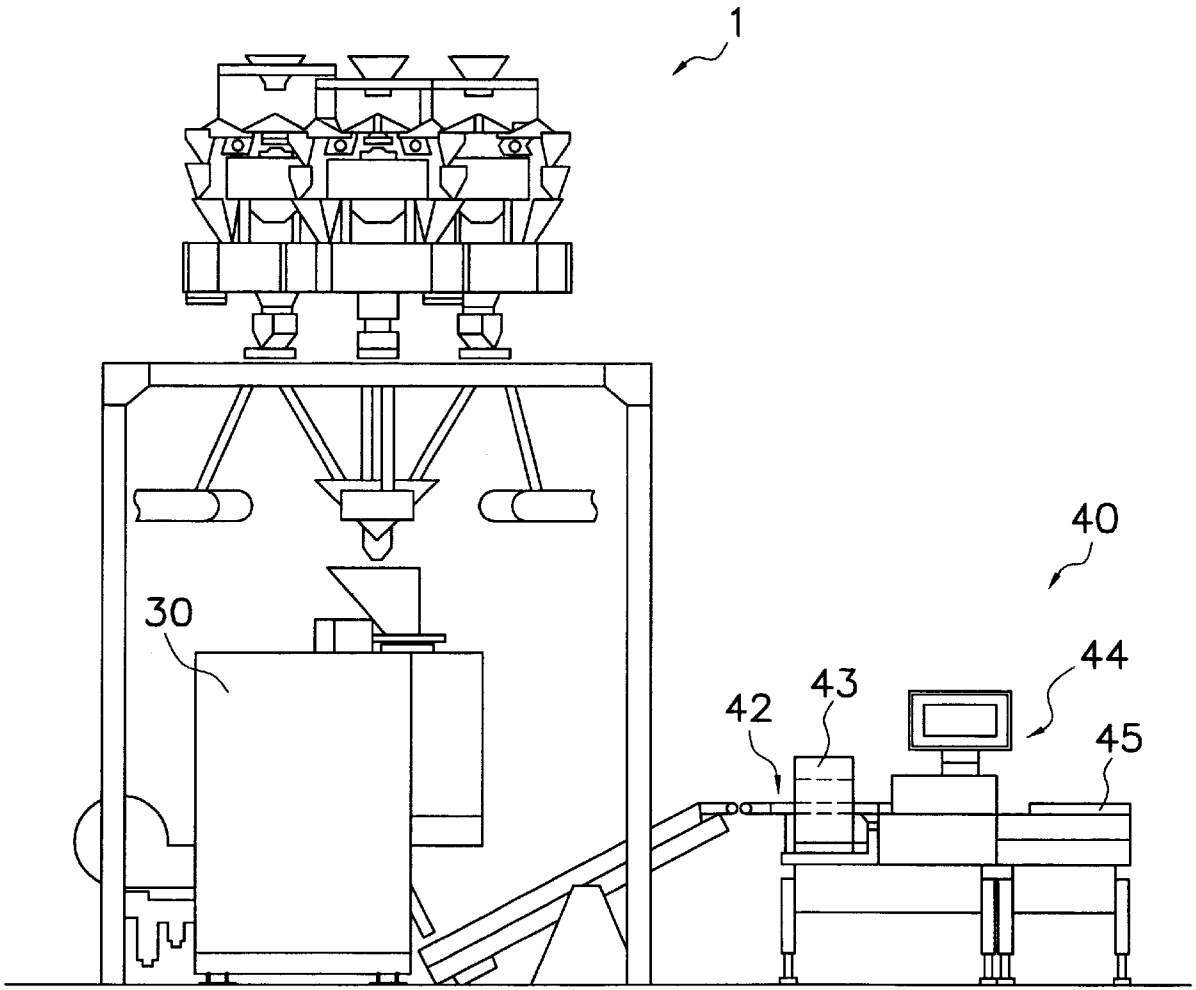
FIG. 1 is a schematic diagram of a liquid delivery system of this invention for the delivery of a gas from a liquid source to an endpoint.

The apparatuses and methods of this invention permit the delivery of a completely vaporized gas having substantially constant impurity levels from a source of a liquefied gas to an endpoint. A vaporized gas having substantially constant impurity levels is obtained utilizing a system wherein a liquefied gas, along with the soluble impurities dissolved therein, is withdrawn from a source of supply and conveyed to a vaporization unit. The vaporization unit comprises a vaporizing means and sufficient heat and flow-regulating devices to ensure that all of the liquefied gas and the soluble impurities entering the vaporization unit undergo a phase change to the gas phase. As a result, a pool of the liquefied gas and the soluble impurities does not accumulate in the vaporization unit during operation of the system. Consequently, the soluble impurities do not build up in any component of the vaporization unit or in the storage container, but rather are emitted in the vapor phase product (i.e., the vaporized forms of the gas and the soluble impurities) at a constant concentration. The vapor phase product is then directed from the vaporization unit to an endpoint.

As used herein, the term "liquefied gas" refers to any gas that can be liquefied and then vaporized to form a gas, and that is maintained under the necessary pressure and temperature required in order to maintain the gas in liquid form.

The terms "soluble impurities," "impurities, " and "dissolved impurities" are used interchangeably herein and refer different forms of the impurities that are soluble in or capable of being dissolved in the liquefied gas. For example, the terms "dissolved impurities" and "soluble impurities" refer to the impurities dissolved in the liquefied gas that are subsequently delivered along with the liquefied gas into the vaporization unit where they are completely vaporized. The terms "impurities" and "soluble impurities" when used in reference to the resulting vapor phase product refer to the vaporized form of the impurities that were dissolved in the liquefied gas.

As used herein, the term "substantially constant impurity levels" is intended to mean that the concentration of impurities in the vapor phase product is substantially equivalent to the concentration of soluble impurities in the liquefied gas source, and further, that the concentration of soluble impurities in the liquefied gas source does not fluctuate substantially as a function of time, temperature, pressure, flow rate, etc.

As used herein, the term "endpoint" refers to a component to which the vapor phase product is delivered from the vaporization unit. Examples of endpoints include, but are not limited to, a semiconductor fabrication tool, a valve manifold box used for distributing the vapor phase product to multiple semiconductor tools, or a gas purifier for removing water and/or other impurities from the vapor phase product.

The apparatus of this invention utilizes a vaporization unit, which includes a vaporizing means for converting the liquefied gas and the impurities dissolved therein to a vaporized product. The specific type of vaporization unit used is not critical. Rather it is critical that the vaporization unit is capable of completely vaporizing all of the liquefied gas and the soluble impurities that enter the vaporization unit to ensure that none of the impurities build up in the vaporization unit. In this manner, the level of the soluble impurities in the source container and in the vapor phase gas product remains constant throughout the operation of the system. Accordingly, it was discovered that certain conventional vaporization units might require modifications in order to achieve 100% vaporization. For example, it was discovered that shell side vaporizers typically used in conventional vaporization units, such as that described in U.S. Pat. No. 5,894,742, supra, can vaporize a liquid at low vapor phase flow rates but cannot completely vaporize liquids at high vapor phase flow rates, even when modified as described in Example 6.

The vaporization unit of the delivery system of this invention is preferably designed to ensure that the liquefied gas and its soluble impurities are completely vaporized at any flow rate. The design of the vaporization unit preferably ensures that heat transfer efficiency is maximized. In addition, the vaporization unit is preferably insulated by methods well known in the art to prevent condensation of the vaporization product.

One embodiment of a delivery system 1 of this invention can be described with reference to FIG. 1. Such a system may be used for the delivery of liquefied gases including, but not limited to, ammonia ($NH_3$), hydrogen chloride (HCl), hydrogen bromide (HBr), chlorine ($Cl_2$), tungsten hexafluoride ($WF_6$), hydrogen fluoride (HF), carbon dioxide ($CO_2$), nitrous oxide ($N_2O$), nitrogen dioxide ($NO_2$), dicholorosilane ($SiH_2Cl_2$), trichlorosilane ($SiHCl_3$), carbonyl sulfide (COS), sulfur hexafluoride ($SF_6$), phosphine ($PH_3$), arsine ($AsH_3$), disilane ($Si_2H_6$), chlorine trifluoride ($ClF_3$), and boron trichloride ($BCl_3$), halogenated compounds including, but not limited to, $CF_4$, $NF_3$, $CHClF_2$, $CClF_2CF_3$, $CClF_3$, $CHCl_2F$, $CH_2F_2$, and $CH_3F$; hydrocarbons including, but not limited to, butadiene, ethane, ethylene, butane, butene, isobutane, propane, propylene, methylacetylene-propadiene ("MAP"), and methylacetylene-propadiene mixtures stabilized with alkane and alkene hydrocarbons; amines including, but not limited to, triethylamine, dimethylamine and monoethylamine; organometallic precursors including but not limited to, trimethylgallium, trimethylaluminum, and trimethylindium; rare gases including, but not limited to, krypton, neon, xenon; and bulk gases including, but not limited to, argon, nitrogen, helium, hydrogen, and oxygen. However, while the following discussion focuses on the use of electronic specialty gases, it is to be understood that the apparatus and method of this invention are not limited only to gases used in the microelectronics industry, but are useful for gases in other industries as well, such as the petroleum industry, the pharmaceutical industry, or any other industry where compressed liquefied gases are employed as gas sources.

FIG. 1 is a schematic representation of one embodiment of a delivery system of this invention. Delivery system 1 includes a storage or source container 10 containing a gas stored in the liquid phase under its own vapor pressure. Storage container 10 is temporarily connected to a first end of delivery conduit 12, which conveys the liquefied gas from the storage container 10 to the vaporization unit 18. A second delivery conduit 13 delivers the vapor phase product from the vaporization unit 18 to an endpoint 50. Delivery conduit 13 delivers the vapor phase product at flows rate ranging from 0.001 standard liters per minute (slpm) to at least 10,000 slpm. The specific flow rate will depend on the type of vaporization unit employed in the delivery system and the flow rate requirements of the vapor phase product.

The delivery conduits of the delivery system of this invention are preferably, fabricated from high purity piping components such as, but not limited to, electropolished 316 L stainless steel, and comprise welded construction and/or metal-to-metal seal fittings. The specific material selected will depend, of course, upon the nature (e.g., corrosiveness, reactivity, etc.) of the liquefied gas being delivered. The conduits used in the system of this invention are critical for minimizing intrusion of moisture from ambient environments where the apparatus will be operated. The integrity of the delivery conduits minimizes contamination and moisture. The size of the conduits may be optimized with respect to the flow rate requirements to minimize the pressure drop and the cost of the conduits.

Since storage container 10 is subject to periodically being connected to and disconnected from the delivery conduit 12, the delivery system of this invention is designed with a purge gas source 20 and a vacuum purging system 30 for removing contaminants such as moisture and residual gases from the delivery system, and to prevent introduction of atmospheric contaminants into the apparatus.

The vacuum purging system 30 comprises a vacuum pump or vacuum venturi that may be operated in conjunction with a controller programmed for automatic purging and evacuation. Vacuum pumps can be selected from rotary vain types, rotary pistons, diaphragms, molecular drag types and dry pumps, or other suitable pumps known to those skilled in the art. Prior to connecting the storage container 10 to the delivery conduit 12, the delivery conduits 12 and 13 are subjected to a purge with any suitable dry inert gas in order to ensure low moisture and low contamination in the delivery conduits 12 and 13. The purge gas is delivered from a purge gas source 20, such as a ULSI grade cylinder of nitrogen, helium or argon. The purge gas is introduced through valved line 14 via purge system 30, such as a venturi system, to various critical areas of the delivery conduits 12 and 13. In doing so, other stations along the delivery conduit are also purged of any contained moisture, chemical, or other contaminant. Additionally, the purge is used to avoid entrainment of atmospheric air in the delivery conduits during connection of the storage container 10 to the conduit 12.

The purge gas and contaminants are removed from the delivery conduit 12 by way of line 14 and purge system 30. Contaminants and purge gas are withdrawn through vacuum pump or exhaust system 40 connected to purge system 30 and sent to a separate scrubbing system (not shown) via line 42. Suitable scrubbing systems include an acid scrubber, a base scrubber, or any type of waste treatment system capable of handling high flow rates, depending on the flow rate requirements. The type of scrubber employed is not critical to the apparatus or method of this invention. The exhaust system may be protected from corrosive chemicals by appropriate placement of a filter (not shown) upstream of the vacuum pump or exhaust system 40. The purge and evacuation of the apparatus can be accomplished through an automated sequence that is controlled by an appropriate digital programmable controller.

After purging the delivery system, delivery conduit 12 is temporarily connected to storage container 10 containing the liquefied gas to be vaporized. The storage container 10 can be a bubbler, a cylinder, a ton unit, a tube trailer, or any other type of suitable container, with typical volumes starting from 10 milliliters for a bubbler and 20 liters for a cylinder. Ton units with equivalent volumes of 10 cylinders or tube trailers with equivalent volumes of 350 cylinders have the advantages of lower cost, safety, product quality, and reduced number of cylinder change-outs. The storage container 10 is preferably made of corrosion resistant materials. The wetted surfaces of the interior of the storage container are preferably surface treated, such as by electropolishing, mechanical polishing or electrolytically depositing of certain metals.

Once the storage container is connected to the delivery conduit 12, the liquefied gas and the impurities dissolved therein are delivered from the storage container 10 to the vaporization unit 18, where they are completely converted to the vapor phase. In one embodiment, the storage container 10 includes a dip tube (not shown) to withdraw the liquefied gas from the container. The liquefied gas may also be withdrawn by other methods such as inverting the container, particularly if the container has only one outlet. Alternatively, the liquefied gas may be withdrawn from the storage container 10 using an inert gas pressure head.

In one embodiment, the liquefied gas and the impurities dissolved therein flow from storage container 10 through one or more flow regulating devices 16 capable of controlling the delivery of the liquefied gas prior to delivery to vaporization unit 18. Device 16 minimizes the fluctuations in the pressure of the liquefied gas being withdrawn from the storage container 10, thereby ensuring the introduction of the liquefied gas into vaporization unit 18 at a controlled rate. Device 16 also assists in minimizing fluctuations in the soluble impurity concentration of the liquid delivered to vaporization unit 18. Device 16 can be any device capable of regulating the flow of the liquefied gas, such as a liquid regulator, a throttling valve, or any other system component compatible with the liquid phase of the gas. The size of this component will be determined by the flow rate requirements of the system.

Alternatively, the flow of liquefied gas can be regulated without a flow-regulating device, and instead the pressure contained within the vaporization unit can be used to control the flow of liquefied gas into the vaporization unit. That is, the temperature of the vaporization unit can be sufficiently increased until the pressure of the vapor phase product in the vaporization unit is greater than the pressure of the liquefied gas, thereby preventing the flow of the liquefied gas into the vaporization unit. Conversely, the flow of liquefied gas into the vaporization unit can be resumed by decreasing the temperature of the vaporization unit, thereby decreasing the pressure of the vapor phase product. Thus by adjusting the temperature of the vaporization unit, the flow of the liquefied gas into the vaporization unit can be controlled without a flow-regulating device.

The liquefied gas is delivered via delivery conduit 12 to the vaporization unit 18 where all of the delivered liquefied gas as well as the soluble impurities are completely vaporized to form a vapor phase product. As discussed above, regardless of the type of vaporization unit 18 employed, it is critical that the vaporization unit 18 completely vaporize the liquefied gas and the impurities dissolved therein to prevent the buildup of soluble impurities in the vaporization unit, thereby preventing variation in the concentration of the soluble impurities in the vapor phase product. The vaporization unit 18 is further designed in such a way to ensure that all of the liquefied gas and the soluble impurities delivered from the storage container will be vaporized within the vaporizing means at any vapor phase flow rate.

Vaporization unit 18 comprises a vaporizing means surrounded by or in contact with a heating means for completely vaporizing the liquefied gas and soluble impurities entering the vaporization unit. Examples of vaporization units suitable for purposes of this invention broadly include evaporators that can be classified as follows: 1) the heating medium is separated from evaporating liquid by tubular heating surfaces; 2) the heating medium is confined by coils, jackets, double walls, flat plates, etc.; 3) the heating medium is brought into direct contact with the evaporating liquid; and 4) heating by solar radiation.

More specifically, examples of vaporization units suitable for purposes of this invention include, but are not limited to, tube side vaporizers, forced circulation evaporators, submerged-tube forced circulation evaporators, short-tube vertical evaporators, long-tube vertical evaporators, recirculating long-tube vertical evaporators, falling film evaporators, horizontal-tube evaporators, and hot plates.

This invention contemplates incorporating any vaporization unit known in the art for vaporizing a liquefied gas into the delivery systems of this invention, provided that the vaporization unit is capable of, or has been modified to be capable of completely vaporizing all of the liquefied gas and any soluble impurities that enter the evaporator, wherein the evaporation takes place at a rate that prevents the accumulation of dissolved and/or vaporized soluble impurities in the vaporization unit. Thus, the heating means must be capable of heating the vaporizing means to a temperature sufficient to completely vaporize the liquefied gas and the soluble impurities within the vaporization unit. The temperature necessary to completely vaporize the liquefied gas and soluble impurities will depend, of course, on the type of liquefied gas being delivered.

Figure 2:
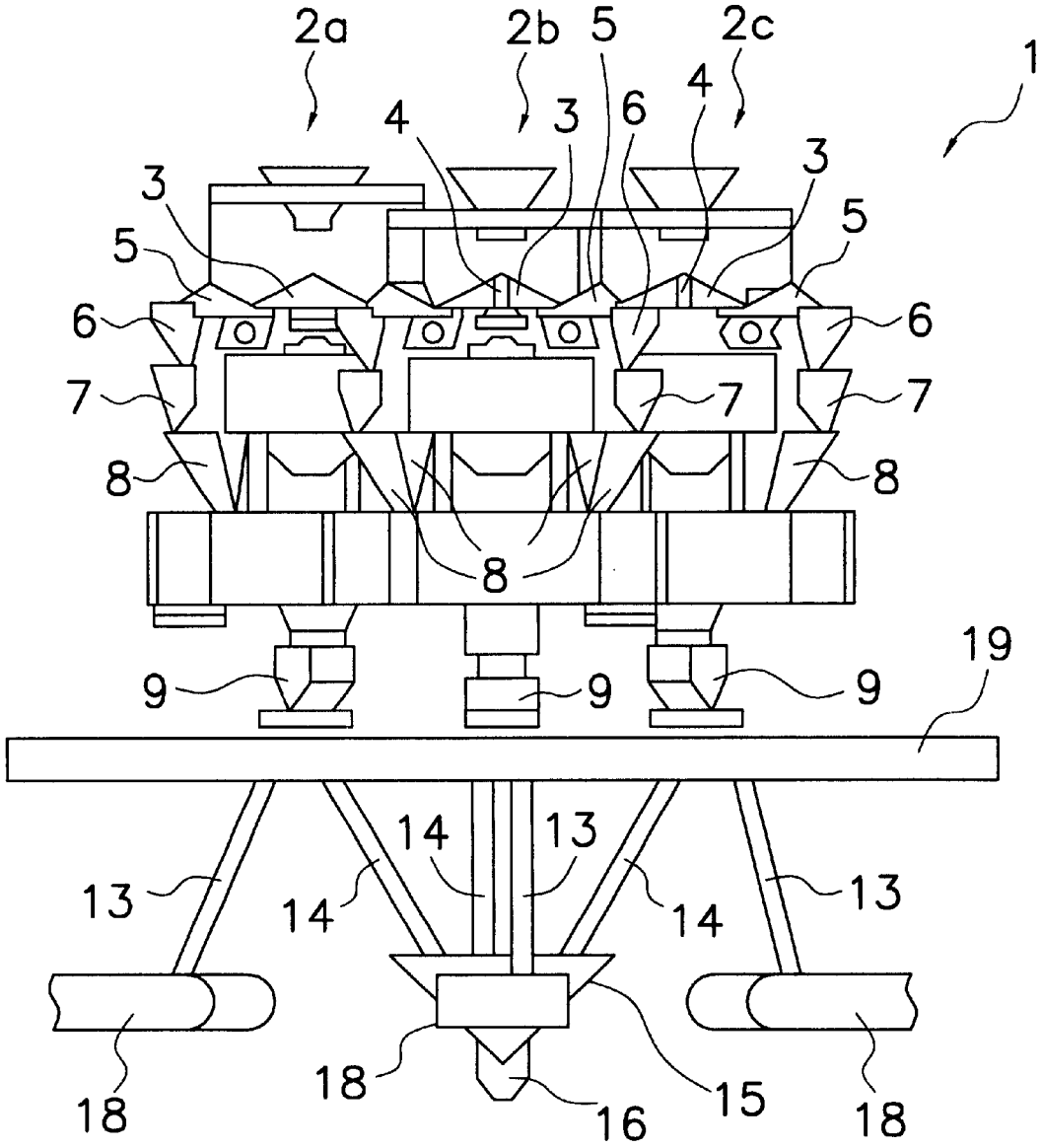
FIG. 2 is a cross-sectional view of a tube side vaporizer of one embodiment of this invention.

FIG. 2 shows the details of one embodiment of a vaporization unit 18 of a delivery system of this invention. In this embodiment, the vaporization unit 18 comprises a housing 25 enclosing a vaporizing means 60, which in this embodiment is a tube side vaporizer. The vaporizing means 60 is heated by a heating means 62. Vaporization unit 18 further comprises an inlet 64 for introducing the liquefied gas into the vaporizing means 60, and outlet 66 for removing the vapor phase product from the vaporizing means 60.

The interior of the vaporizing means 60 is preferably made of a material and with an internal surface finishing appropriate to be inert to the liquefied gas. Typically the interior of the vaporization means is stainless steel that is surface treated by, for example, electropolishing, mechanically polishing, coated by electrolyzed deposition of certain metals.

The vaporizing means 60 is illustrated in FIG. 2 as a double U-shaped tube, however this configuration is provided merely for illustration purposes only and is not meant to be limiting of the configuration or orientation of vaporizing means 60. Thus, other configurations of vaporizing means 60 may be employed in the delivery system of this invention. For example, vaporizing means 60 may comprise one bend or multiple bends, or may be coiled. Further, vaporizing means 60 may be positioned vertically, horizontally, angled, or any other angle in between. Regardless of the configuration, however, it is critical that the vaporizing means is sufficiently heated to prevent pooling of the liquefied gas within the vaporizing means 60 or within any other component of the vaporization unit 18.

In the embodiment illustrated in FIG. 2, the vaporizing means 60 is mounted within a heating means 62 such as a heating block. In this embodiment, the heating means is designed to encase the vaporizing means 60 to provide efficient heat transfer to the vaporizing means 60 and subsequently to the contents flowing therethrough. A close fit of the heating means 62 around the vaporizing means 60 is desired to insure maximum heat transfer between the heating means 62 and the vaporizing means 60.

In one embodiment, the heating block 62 comprises a first and second body half-section, each comprising an interior surface and an exterior surface. Heating block 62 as illustrated in FIG. 2 is formed of a highly heat conductive material, such as for example, aluminum. The interior surface of each half-section has a recessed portion in its surface that is identical to the configuration of the vaporizing means 60. The interior surfaces of the two half-sections of the heating block are joined together with the vaporizing means 60 disposed in the recessed portions and sandwiched therebetween. Clamp means, such as strap bands, hose clamps, welds, spring steel clips, adhesives, or threaded fasteners may be used to clamp the first and second body half-sections together. Alternatively, the heating block can be cast around the vaporizer using a liquid or molten form of the heating block material. It is to be understood, however, that the heating block 62 as shown in FIG. 2 is just one example of a heating means, and that heating means other than a heating block may be employed in the apparatus of this invention.

The vaporizing unit illustrated in FIG. 2 further comprises one or more heating elements 68 embedded in, wrapped around, covering, or otherwise in contact with the heating block. Suitable heating elements include, but are not limited to, resistors embedded in the heating block, heating tape, heating jackets, hot water, steam tracing lines, or an encompassing convection oven, or may be other suitable heating element known to those skilled in the art.

Heating block 62 is operatively associated with a temperature controller 72 adapted to heat the heating block 62 to a temperature necessary for completely vaporizing the liquefied gas and the impurities dissolved therein. In one embodiment, the temperature controller 72 is coupled to a sensor such as a thermocouple that is attached to the heating block 62. In another embodiment, the temperature sensor is located near the outlet of the vaporization unit within the gas stream.

In the embodiment illustrated in FIG. 2, the liquefied gas flows through the vaporizing means 60 where it is completely vaporized. As a result, the soluble impurities do not accumulate in the vaporization unit. The design of vaporization unit 18 of this invention ensures that heat transfer efficiency is maximized. For example, in the embodiment wherein the vaporization means 60 is a tube side vaporizer as illustrated in FIG. 2, heat transfer efficiency is increased using an in-tube vortex generator (not shown) disposed inside the vaporizing means 60 through which the liquefied gas flows. The vortex generator forces the liquefied gas radially outward toward the interior walls of the vaporizing means 60, thus allowing the liquefied gas and the soluble impurities to contact the heating surface and absorb heat, which induces vaporization of the liquid to occur. This prevents the liquefied gas from settling inside vaporizing means 60 and becoming a site for the buildup of the soluble impurities.

The vaporization unit 18 is preferably well insulated with an insulation material such as polyethylene. The heat duty of the vaporization unit 18 depends on the flow requirements of the liquid delivery system.

In one embodiment the vaporization unit 18 includes a control mechanism for low and high-temperature limits. For example, an electropolished solenoid valve can be employed at the inlet of the vaporization unit 18 and activated by a temperature switch located at the outlet 66 of the vaporization unit 18 as a low-temperature limit control mechanism. A high temperature control mechanism, which is used to turn off the heater, can be located at the outlet 66 of the vaporization unit 18 and measures the heat of the vaporization product. Alternatively, the high temperature control mechanism can be located on the heating means 62.

The vapor phase product exiting the vaporization unit 18 is preferably maintained at a constant temperature and pressure. In one embodiment, the vapor phase product present within the vaporization unit 18 and downstream of the point(s) of vaporization is super-heated by the addition of excess heat above the heat necessary for vaporization. This is done to prevent condensation within the vaporization unit 18. In this embodiment, the conduit 13 leading from the vaporization unit is not insulated, and conduit 13 can be used to dissipate heat. Alternatively, if vaporization unit is designed such that the vapor phase product within the vaporization unit 18 does not need to be super-heated, conduit 13 is insulated to prevent condensation of the vapor phase product within conduit 13.

The temperature of the vapor phase product exiting the vaporization unit 18 should also be below a temperature that would be detrimental to system components downstream of the vaporization unit 18. The temperature of the vapor phase product can either be optimized in the vaporization unit 18 or can be lowered further by, for example, a heat exchanger (not shown) located downstream of the vaporization unit 18. The pressure in the vaporization unit 18 can be measured by a pressure transducer or a pressure gauge. The temperatures of both the heating medium and the vapor phase product exiting the vaporization unit 18 can be measured by any known means such as a thermocouple or a resistance temperature detector (RTD).

Downstream of the vaporization unit 18, the vapor phase product pressure is reduced to the desired pressure for endpoint 50 using pressure regulator 22. Regulator 22 should be made of materials that are compatible with the vapor phase product and should be rated to the flow rate requirements of the system.

The delivery system of this invention is capable of maintaining high vapor phase flow rates for longer periods of time relative to conventional gas phase delivery systems. This is due to the fact that in conventional gas delivery systems, the amount of thermal energy transferred to a storage container is limited to the exterior surface area of the container, whereas in the present invention the heating means transfers heat much more efficiently and with a larger heating area compared to a conventional gas delivery system.

The invention can further be modified to include automated controllers in order to control the flow throughout the delivery system. These may be programmable logic controllers.

Ambient temperature conditions as well as appropriate sensors such as thermocouples or pressure transducers are provided for the storage container. In this manner, the ambient temperature at the storage container, the temperature of gas from the storage container, and the relative change in pressure over selected time intervals are sensed and transmitted to an appropriate digital computational controller. These values are compared against preset values for ambient temperature, storage container temperature, and pressure decay, which are indicative of the liquid dry point (gas phase). When the sensed values exceed the prescribed preset values, thus indicating that the liquid dry point has been reached, the controller provides an appropriate alarm signal. Suitable alarm signals include an audible siren, a visual light, a report on a computer system, or any combination of such features. Additionally, weight scales can be used to determine the appropriate switchover point.

In an alternate embodiment, the delivery system of this invention can be further modified to incorporate two or more storage containers 10 in parallel to allow replacement of the container with minimum amounts of atmospheric contaminants being introduced into the system.

In another embodiment, the delivery system of this invention can be further modified by the addition of one or more purifiers downstream of the storage container 10. In one embodiment, one or more gas purifiers can be positioned between the storage container 10 and the vaporization unit 18. In another embodiment, the gas purifier can be positioned between the vaporization unit 18 and the endpoint 50. Alternatively, the endpoint 50 is a gas purifier. Improvement in the gas quality translates into an economic enhancement in the manufacturing process, more reliable and consistent equipment performance, and reduction in equipment maintenance or replacement. Purification of both the source gas and point of use purification of electronic specialty gases minimizes the effect of particulate contamination caused by corrosion and reduces the chemical contamination to negligible levels. In addition, purification minimizes the contamination caused by impurity fluctuations and atmospheric intrusions.

The invention is further illustrated by the following non-limiting examples. All scientific and technical terms have the meanings as understood by one with ordinary skill in the art unless otherwise specified. The specific examples that follow illustrate the methods in which the apparatus and process of this invention may be employed in a semiconductor fabrication tool and are not to be construed as limiting of the scope of the invention. The methods and apparatus of this invention may be adapted to utilize gases other than electronic specialty gases. Further variations of the methods and apparatus to produce the same vaporized gaseous phases in somewhat different fashion will be evident to one skilled in the art.

EXAMPLE 1

Figure 3:
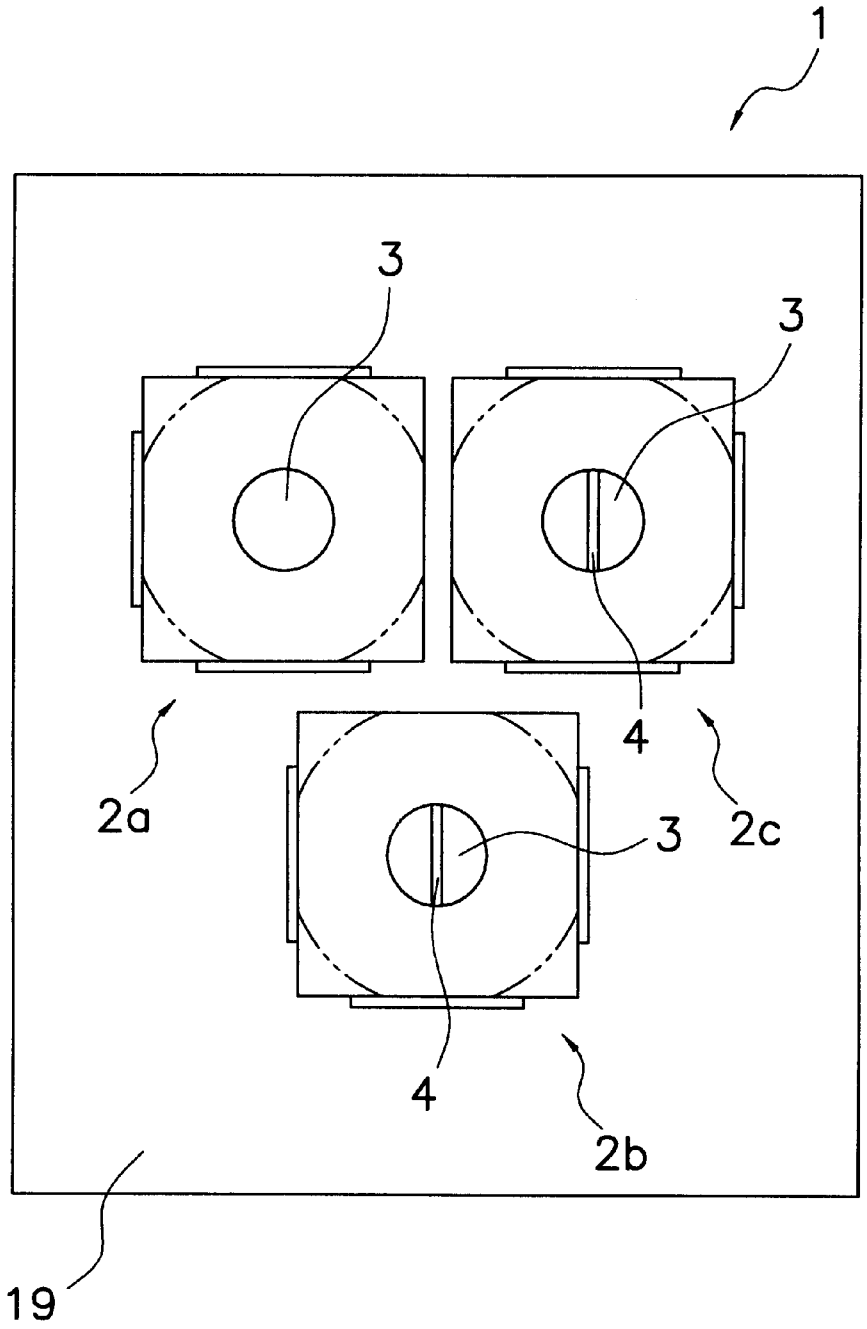
FIG. 3 is a graph plotting the water concentration in liquid phase ammonia as a function of time at flow rates from 2 to 250 standard liters per minute (slpm) using a liquid delivery system of this invention.

Stability of Water Concentration as a Function of Time at Various Flow Rates Experiments were conducted to determine the performance and the characteristics of a delivery system of this invention. The liquid delivery system was evaluated at a wide range of flow rates and operating conditions. FIG. 3 summarizes the results obtained using a storage container comprising a ton unit having 190 pounds (lbs.) of ammonia at the beginning of the test and 35 lbs. of ammonia at the end of the test. The ammonia was withdrawn in the liquid phase from the ton unit and completely vaporized in the vaporization unit, that is, externally from the ton unit. The temperature of the vaporizing means was set to 70° C. FIG. 3 shows the measured water concentration as a function of time at flow rates of 50, 100, 225, and 250 standard liters per minute (slpm).

The drastic decrease in moisture concentration at approximately 725 minutes was due to the liquid level of the ammonia falling below the dip tube used to withdraw liquid phase ammonia from the ton container. When the liquid level decreased to levels below the dip tube, the water concentration started to decrease as the ammonia was being delivered in the gas phase, and a single plate distillation was occurring in the container. The water concentration then increased due to the accumulation of water in the liquid ammonia. At about 875 minutes, when the ton unit was liquid dry, the water concentration increased exponentially. This transition from liquid phase delivery to gas phase delivery occurred when the ton container had only 35 lbs of product remaining in the container that started with approximately 800 lbs. of ammonia. This represents over 95% delivery of the original product loading delivered from the liquid phase.

Figure 4:
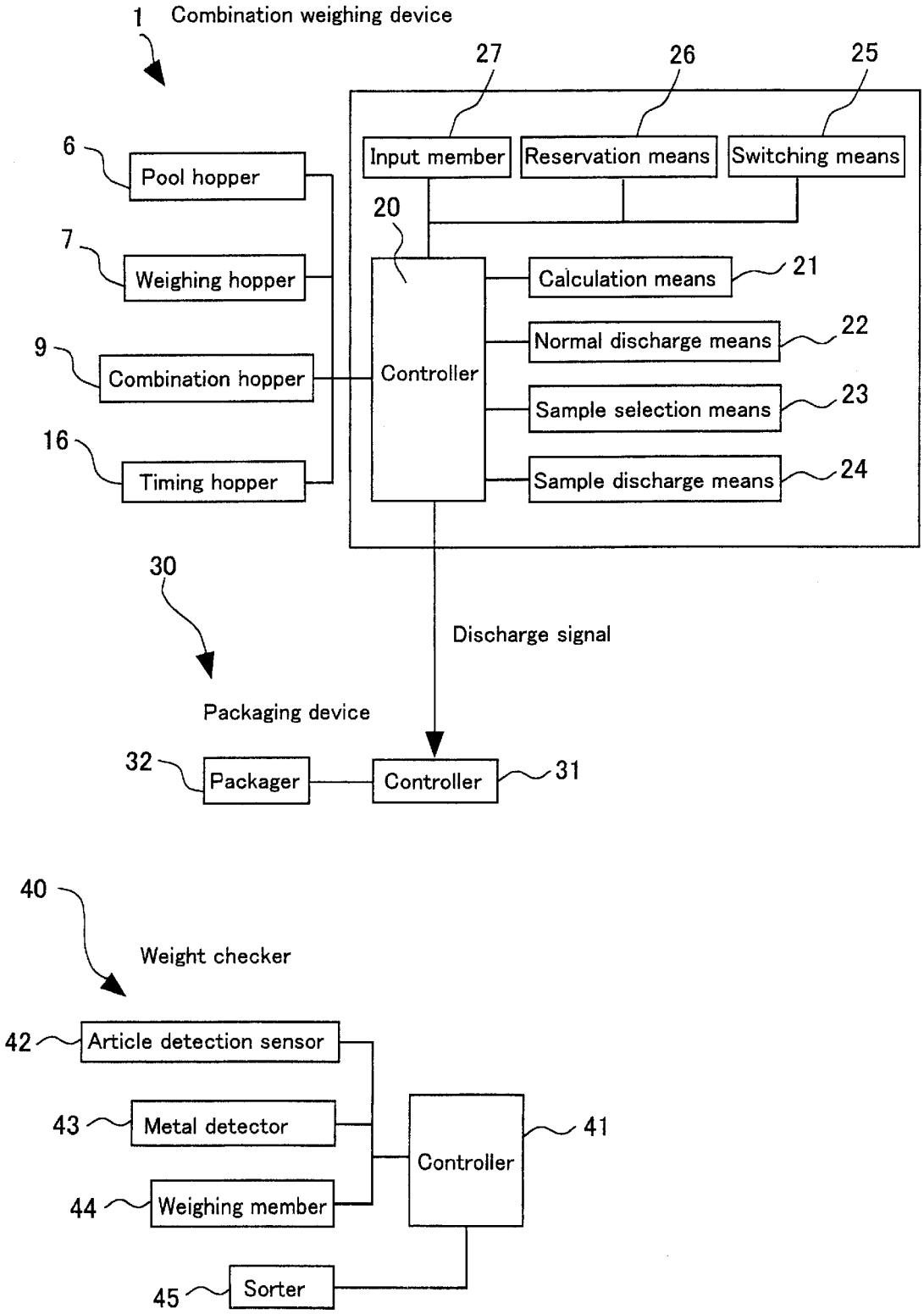
FIG. 4 is a graph plotting the measured water concentration as a function of time at flow rates of 100, 250, and 750 slpm using a liquid delivery system of this invention.

FIG. 4 shows the measured water concentration as a function of time at flow rates of 100, 250, and 750 standard liters per minute (slpm). The concentration of water was constant and equal to the direct ton unit liquid phase concentration, which was about 160 parts per million (ppm). The average of the absolute deviation in the data was 3 ppm, or less than 2% of the absolute moisture concentration. The absolute deviation includes the fluctuations in the data due to the changes in the flow rate. The pressure was constant at about 50 pounds per square inch gauge (psig) and the average temperature at the outlet of the vaporization unit was about 100° C. Under these conditions the ammonia was superheated.

Figure 5:
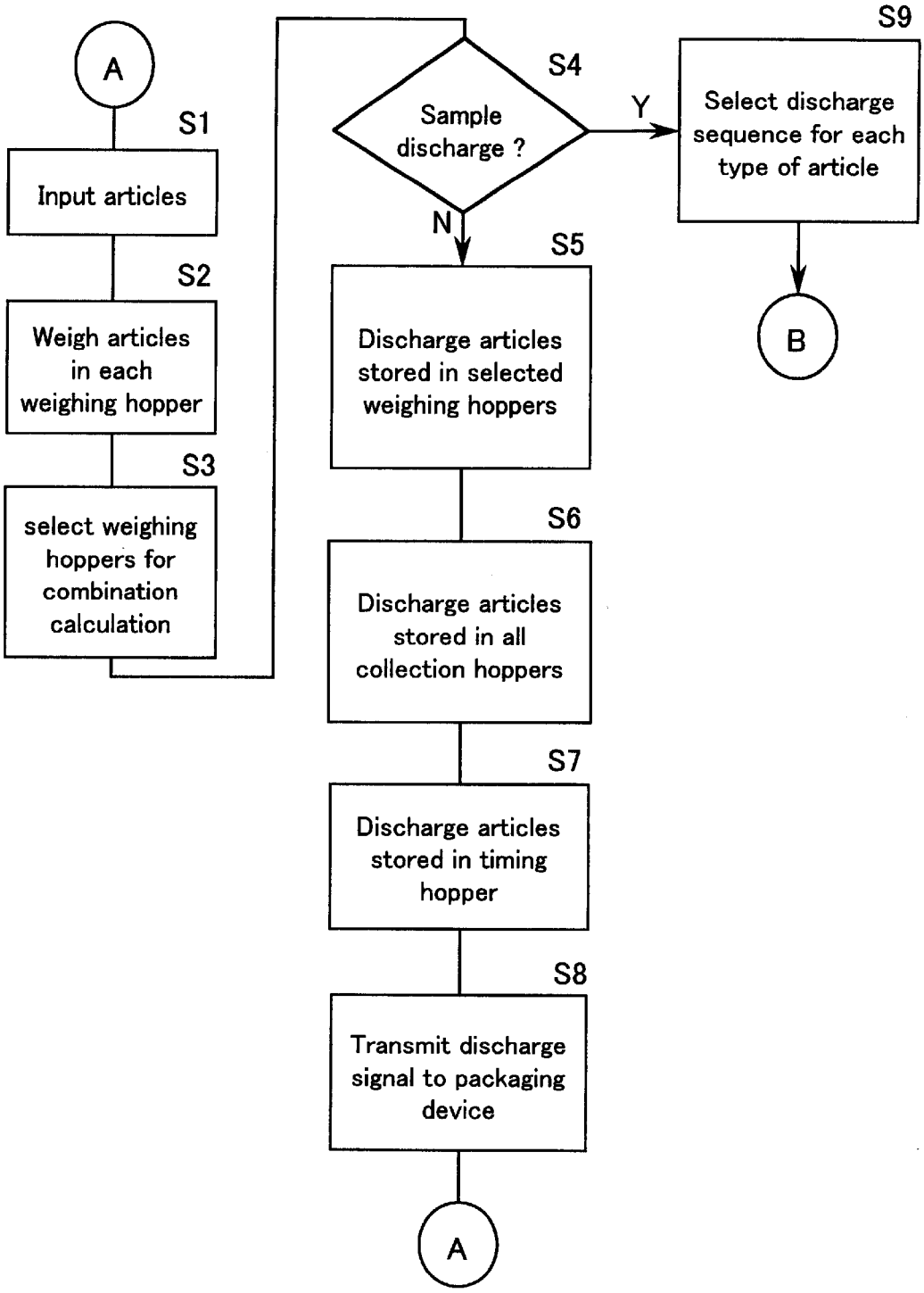
FIG. 5 illustrates constant moisture levels at flow rates from 2 slpm to 500 slpm for an ammonia cylinder having a liquid phase water concentration of about 3 ppm.
Figure 6:
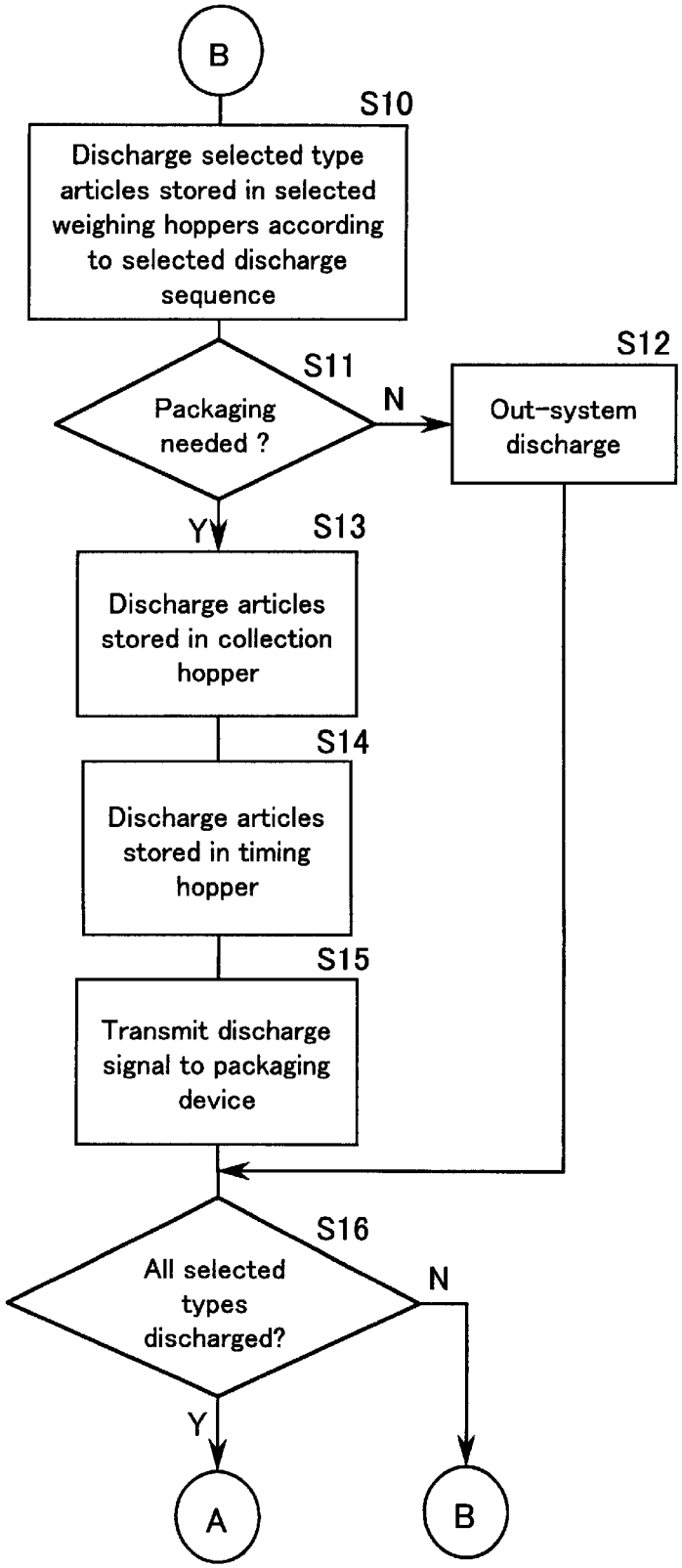
FIG. 6 illustrates constant moisture levels at flow rates from 2 to 250 slpm having a liquid phase water concentration below the FTIR detection limit of 30 ppb.

Experiments were also conducted using different sources of ammonia to understand how the system works at low water concentrations. A cylinder was filled with ammonia having a water concentration of about 3 ppm and was inverted for liquid delivery (FIG. 5). Additionally, an ammonia cylinder was tested having a liquid phase water concentration below the FTIR detection limit of 30 ppb (FIG. 6). FIGS. 5 and 6 show that the delivery system of this invention maintains constant water concentrations that are independent of the starting concentration of the impurities dissolved in the liquefied ammonia. FIG. 5 illustrates constant moisture levels at flow rates from 2 slpm to 500 slpm with the average absolute deviation in the data reported at less than 5% of the absolute moisture concentration of 2.9 ppm. FIG. 6 illustrates constant moisture levels at flow rates from 2 to 250 slpm with no discernable difference in moisture concentration between purified and unpurified ammonia. Previous results have demonstrated the purified ammonia to be less than 30 ppb water in ammonia. The trend of decreasing moisture levels as a function of time was due to dry-down of the instrument and sampling lines of the instrument. At these concentrations the effect of the drying down of the instrument and sampling lines was significant.

This example demonstrates that the delivery system of this invention maintains constant water concentrations, constant temperature, and constant pressure at a wide range of flow rates. This example also demonstrates that high flows can be maintained for long periods of time. The water concentration was constant throughout the experiments until only 35 lbs. were left in the ton unit, which is less than 5% of the initial ammonia in the ton unit. Thus, this example further demonstrates that the delivery system of this invention allows for substantially complete use of the contents of the storage unit.

This example also demonstrates that the delivery system of this invention maintains constant water concentrations that are independent of the starting concentration of the impurities dissolved in the liquefied ammonia.

EXAMPLE 2

The Stability of the Water Concentration as a Function of Time at 250 slpm

Figure 7:
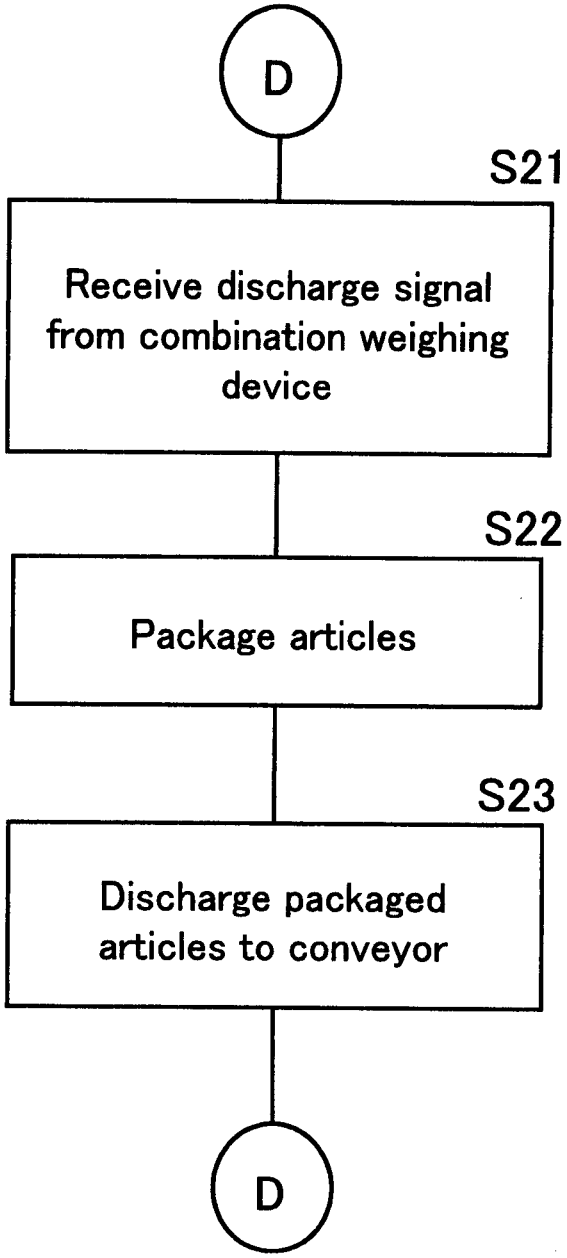
FIG. 7 is a graph plotting the water concentration in liquid phase ammonia as a function of time at 250 slpm for a period of approximately 7 hours using a liquid delivery system of this invention.

Further tests were conducted to demonstrate the stability of the water concentration in a ton unit for long periods of time. Tests were done at 250 slpm for a period of 7 hrs. The results of the measurements of the water concentration as a function of time are shown in FIG. 7. A flow rate of 250 slpm was selected because the growth of gallium nitride films is currently done at similar flow rates using ammonia. The water concentration was constant throughout the course of the experiments and the average of the absolute deviation in the data was only 1.6 ppm.

This example demonstrates that the delivery system of this invention maintains constant water concentrations, constant temperature, and constant pressure for long periods of time. This example also demonstrates that high flow rates can be maintained for long periods of time. Any other impurity dissolved in the liquid phase is expected to behave the same way and remain constant throughout the consumption of any storage unit.

EXAMPLE 3

Figure 8:
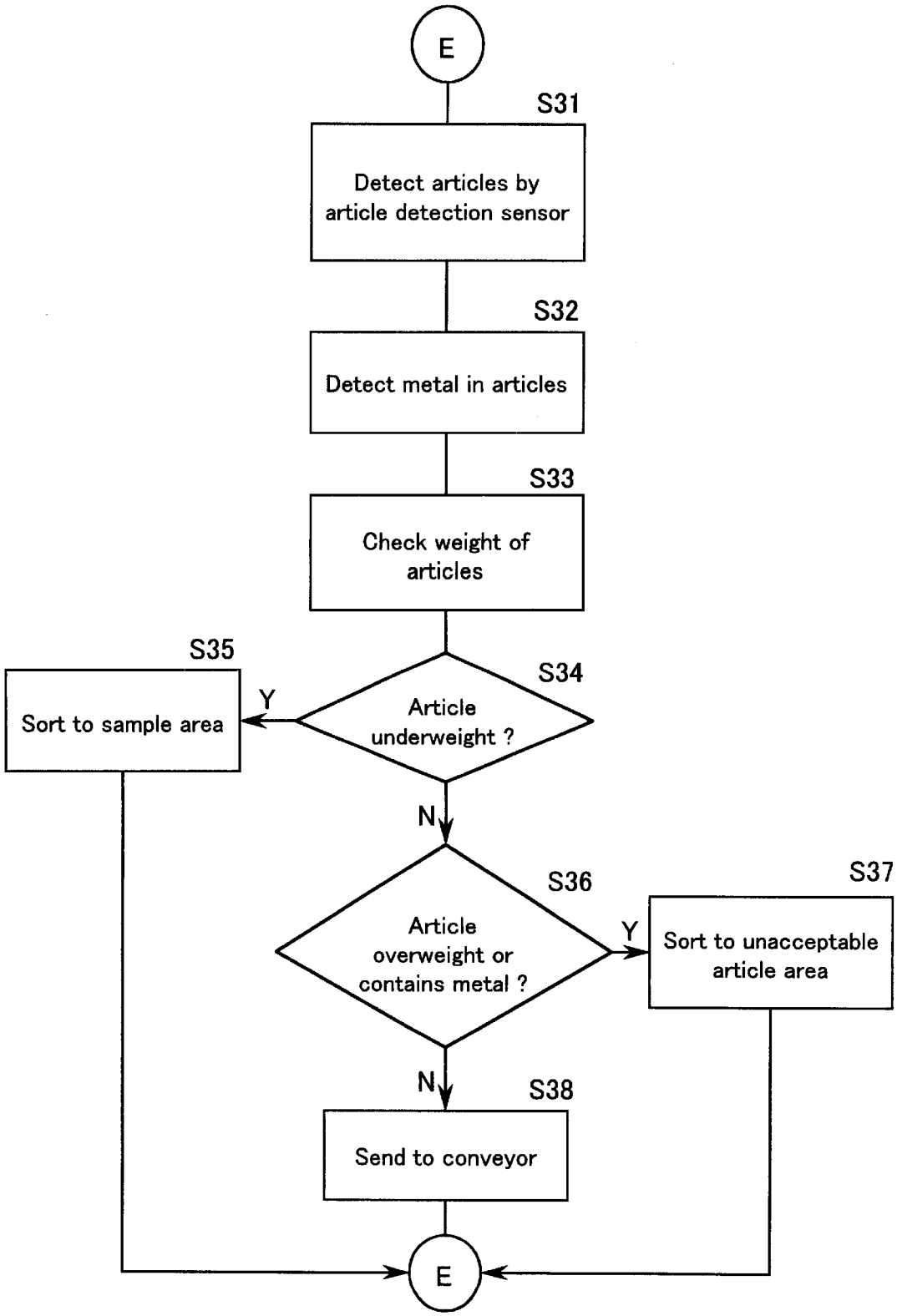
FIG. 8 is a graph plotting the change in the water concentration in an ammonia container using a conventional gas delivery system.

Change in Water Concentration in an Ammonia Cylinder During Gas Phase Delivery This example illustrates the disadvantages of conventional gas delivery systems. In conventional gas delivery systems, a liquefied gas is withdrawn from a storage container in the gas phase. In such systems, the water concentration in the gas phase increases steadily and spikes dramatically at the point when the liquid level goes to zero, as shown in FIG. 8. As vapor is withdrawn, the liquid phase is vaporized to replace the withdrawn gas and maintain the equilibrium pressure. Since water is initially more concentrated in the liquid phase of the liquefied compressed gas, its concentration in the vapor phase increases as the cylinder content is consumed. This increase in impurity concentration may influence the process performance and reduce the amount of product usage.

FIG. 8 summarizes the increase in moisture concentration from an ammonia cylinder throughout its consumption using conventional gas delivery systems. The data show the measured water concentration as a function of time at a flow rate of 5.2 slpm. The initial liquid phase water concentration was 38 ppm. FIG. 8 shows that the water concentration in a liquefied gas cylinder may increase above 1000 parts per million at the point when all of the liquefied gas has been vaporized. This value is much higher than the initial liquid phase concentration of 38 ppm.

In contrast, during a liquid phase delivery such as the delivery system of this invention, the water concentration of the liquid phase remains the same until all the contents of the storage container are consumed, as shown in the previous examples.

EXAMPLE 4

Change in Water Concentration in an HCl Ton Unit During Gas Phase Delivery

Figure 9:
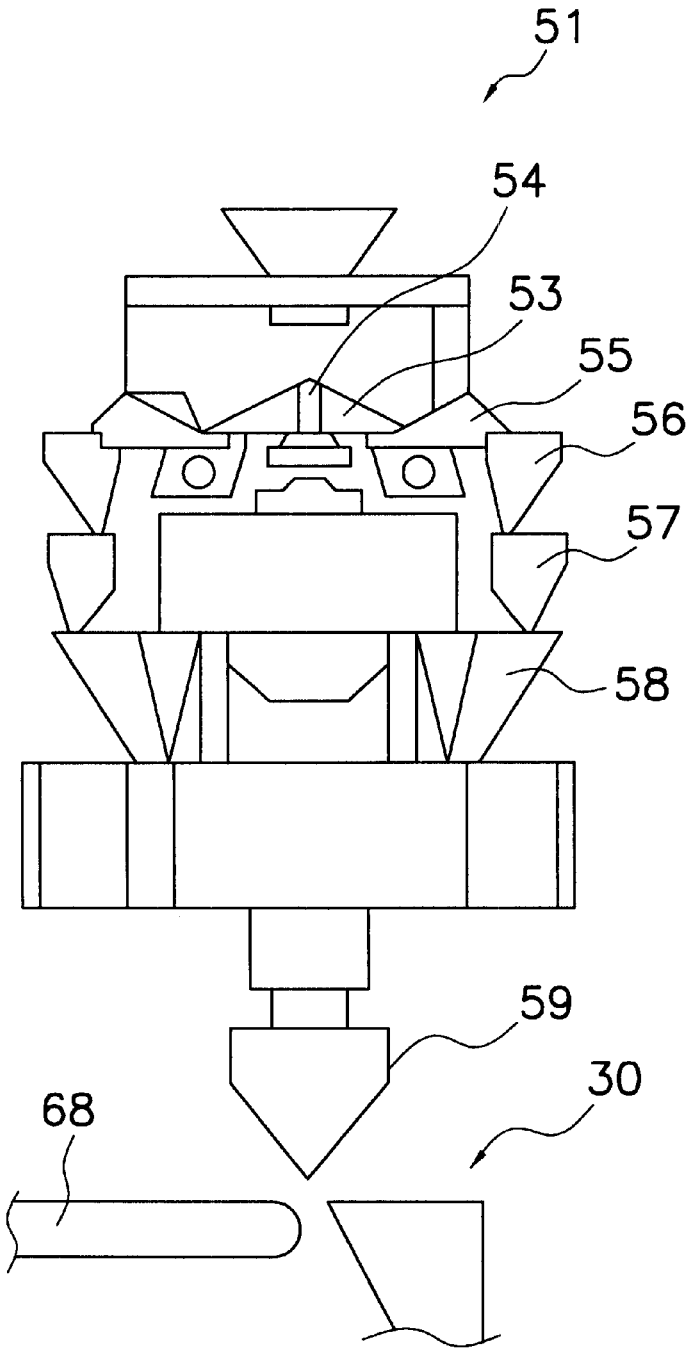
FIG. 9 is a graph plotting the change in the water concentration in a hydrogen chloride ton unit using a conventional gas delivery system.

Another example of the increase in the water concentration during a conventional gas delivery is summarized in FIG. 9. This graph shows the measured water concentration as a function of the remaining hydrogen chloride in a 436-liter ton unit. The water concentration in gas phase HCl in a ton unit was measured until almost all the contents of the ton unit were consumed. The water concentration was initially at sub-ppm levels, but increased to about 125 ppm when 2.0% HCl was left in the ton unit. This not only affects the performance and yield of a semiconductor product prepared with such a gas, but also reduces the amount of the gas that can be consumed due to high levels of impurity concentrations. For example, these results demonstrate that the user will have to switch to a different ton unit when there is 30% HCl remaining in the ton unit in order to have not more than 10 ppm water in the HCl gas stream. This in turn leads to an increase in the cost of the material.

In contrast, during a liquid phase delivery using the delivery system of this invention, the water concentration of the liquid phase remains the same until all the gas in the storage container is consumed, as shown in the previous examples. Therefore, this invention provides complete usage of any storage container and reduces the material costs significantly.

EXAMPLE 5

Figure 10:
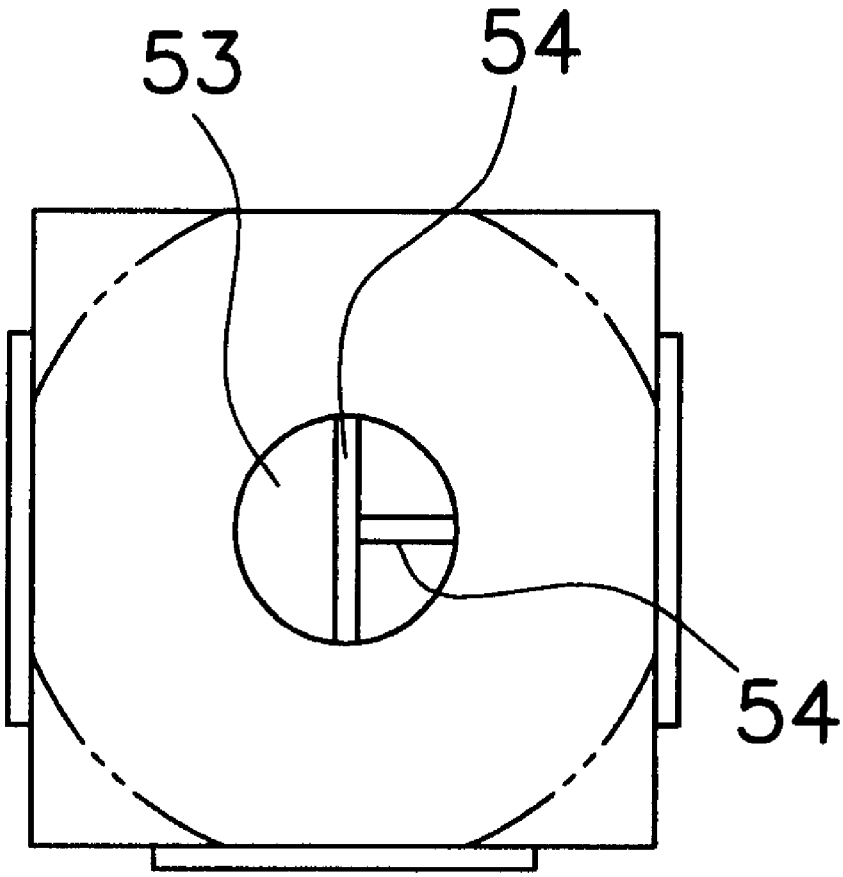
FIG. 10 is a graph plotting the change in temperature for an HCl ton unit using a conventional gas delivery system.

Change in Temperature in a Hydrogen Chloride Ton Unit During Gas Phase Delivery The change in the temperature for a 436-liter hydrogen chloride ton unit using conventional methods is shown in FIG. 10 for gas flow rates of 100, 500, and 900 slpm as a function of time. The temperature was measured on the surface of the ton unit. The surface temperature of the ton unit decreased due to the evaporative cooling when the gas was withdrawn in the vapor phase. The data show that the temperature decreased 5° C. in only 10 minutes at 900 slpm. At this temperature it becomes impossible to continue to flow at 900 slpm under these conditions using gas phase delivery. This is due to the decrease in the vapor pressure of the gas, which occurs because of the decrease in the temperature of the ton unit.

In contrast, with delivery system of the present invention, it is possible to flow at high flow rates for long periods of time, since the temperature and the pressure inside the storage container remain the same throughout the course of consumption of the gas.

Similarly, it was observed that for a chlorine ton unit, the maximum obtainable flow rate decreased from 900 to 150 slpm in only 3 hours due to evaporative cooling (data not shown) when a conventional gas delivery system is used. It can easily be demonstrated that all the compressed liquefied gases used in the semiconductor industry will behave similarly. Therefore, it is impossible to maintain a high flow rate for a long period of time for a conventional gas delivery system.

EXAMPLE 6

Instability of Water Concentration Using a Conventional Vaporization Unit

A commercially available vaporizer was tested as a conventional vaporization system for ammonia. The vaporizer works as a pool-boiling type similar to the vaporizer described in U.S. Pat. Nos. 5,894,742 and 6,032,483. The vaporizer was purchased and sized for ammonia usage rates up to 1000 slpm. The principle of operation for such a purifier involves control sensors placed in the vaporizer to maintain a liquid level of liquefied gas such that the level of the liquefied gas is substantially constant and filled to about 70 percent of the total capacity. The liquid level is maintained independent of the gas usage downstream of the vaporizer. Heaters are submersed into the liquid and vaporization takes place at the interface of the heating element and the liquid. The vaporizer is more energy efficient when the liquid level is high so that the majority of the heating elements are in direct contact with the liquid ammonia. Heating can be in the form of electric resistive heaters, hollow tubes filled with water or steam, or other common heating methods. It is normal operation for this system to be periodically drained and cleaned out to discard from the system the growingly impure liquid phase chemical. In these experiments the extent of the moisture fluctuations during normal operations such as flow rate changes, constant flow, and flow stops was investigated. Additionally, this vaporizer was investigated to test how it could perform in a capacity as a total vaporization vaporizer (i.e., capable of vaporizing 100% of the liquefied gas). This was achieved by drastically slowing the flow rate of ammonia into the vaporizer and allowing the heaters to completely vaporize the entering ammonia. Results showed the vaporizer could operate as a total vaporizer for flow rates less than about 10 slpm. Furthermore, an attempt was made to modify the conventional vaporizer to enhance the ability to function as a total vaporizer. Results from this modification are presented below.

Figure 11:
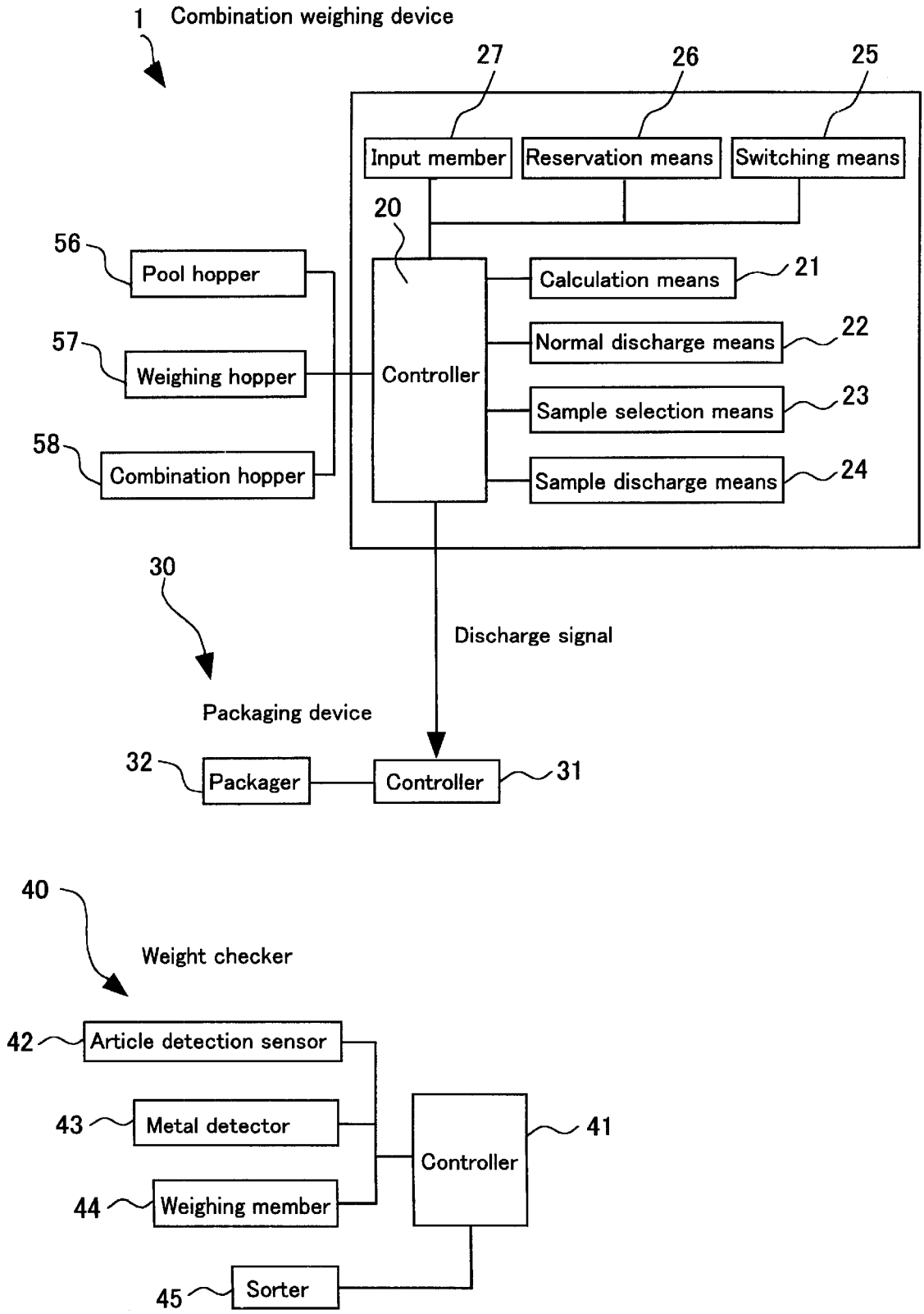
FIG. 11 is a graph plotting the change in water concentration in ammonia vaporized in a conventional pool-boiling type vaporizer at flow rates between 2 and 1000 slpm.
Figure 12:
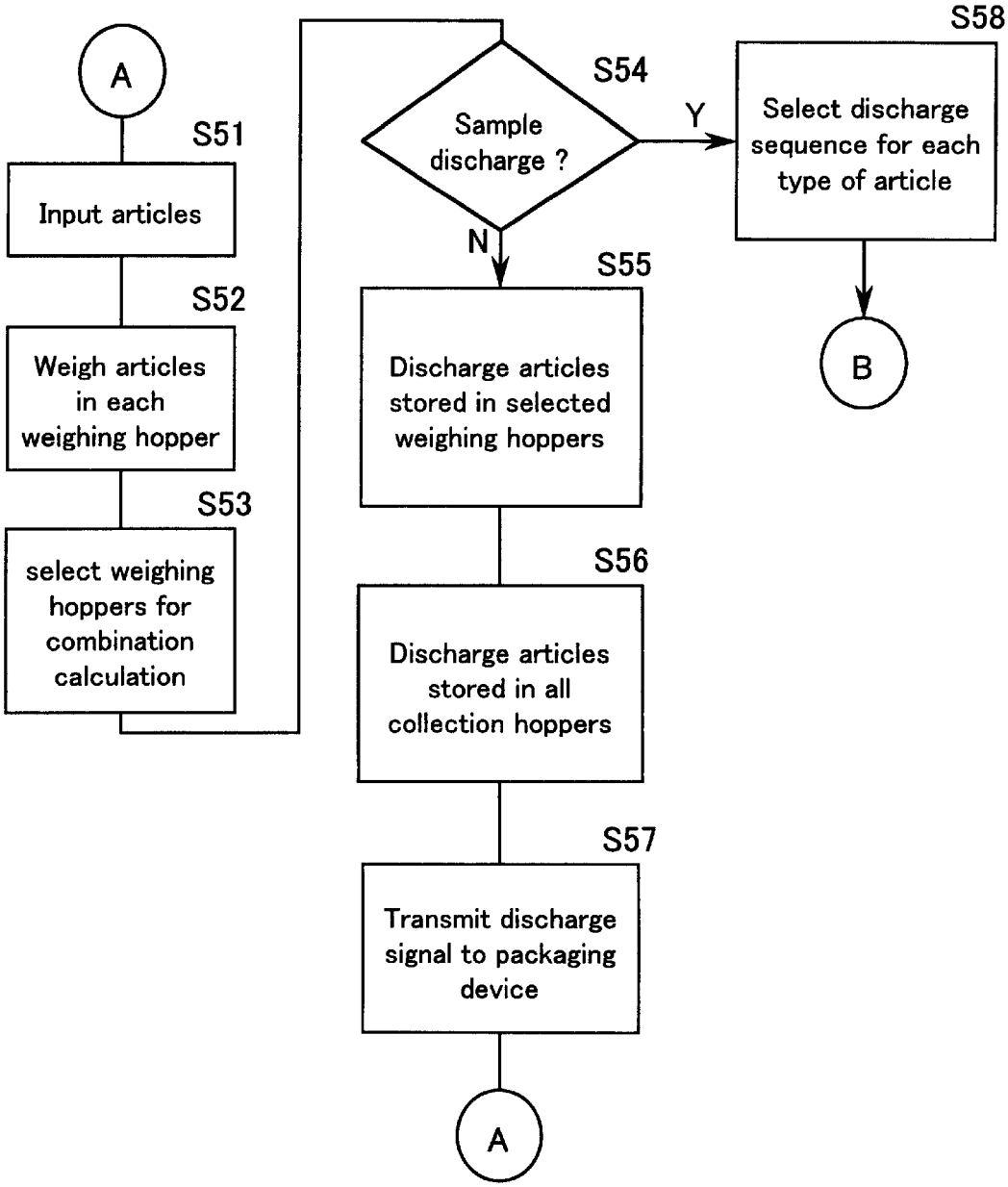
FIG. 12 is a graph plotting the change in water concentration in ammonia vaporized in a conventional pool-boiling type vaporizer at 50 slpm.
Figure 13:
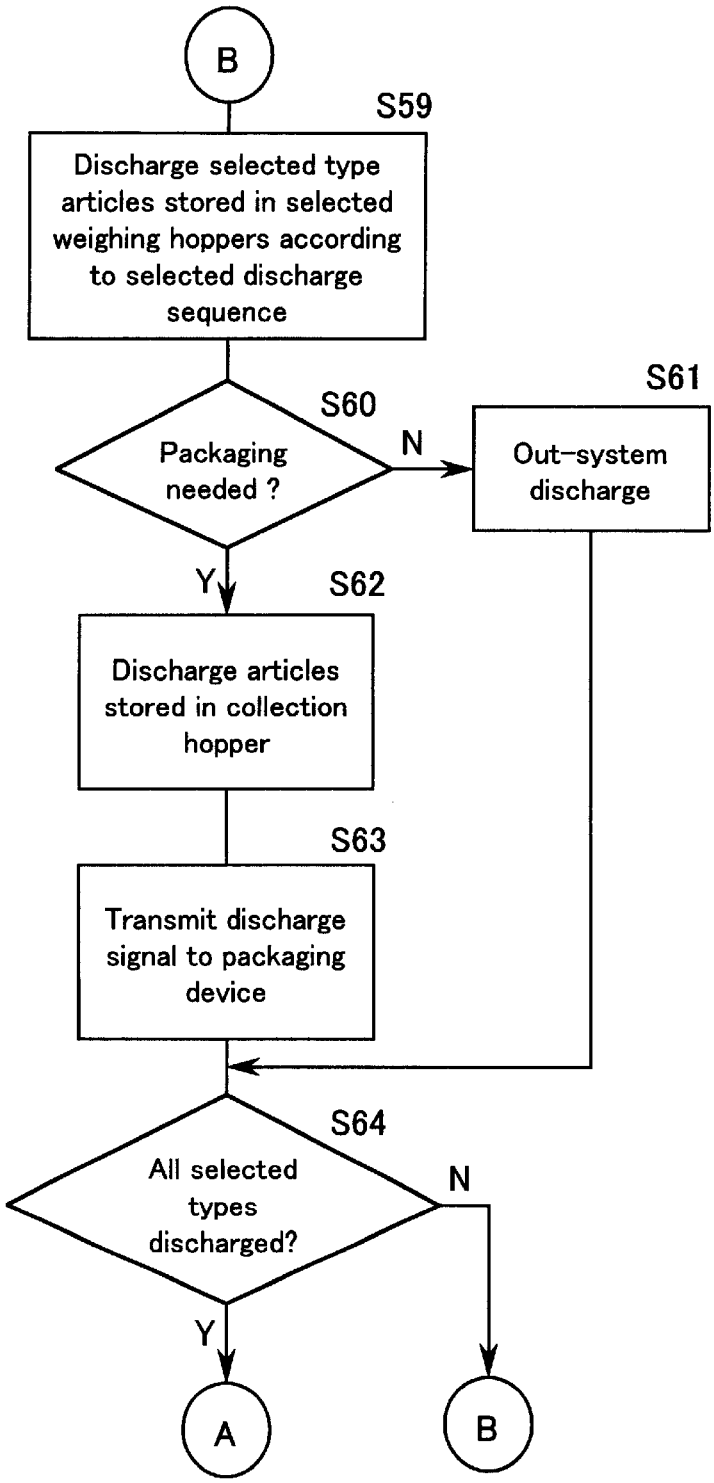
FIG. 13 is a graph plotting the change in water concentration in ammonia vaporized in a conventional pool-boiling type vaporizer at flow rates between 2 and 1000 slpm.

Experiments were conducted at a wide range of flow rates between 2 to 1000 slpm in order to understand the operating principles and performance of the vaporizer. FIG. 11 shows that at low flow rates, such as 2 slpm, ammonia was completely vaporized, yielding water concentrations similar to the direct liquid phase measurements from the ton unit at about 160 ppm. At higher flow rates, beginning at 15 slpm, oscillations in the water concentration began due to the temperature oscillations taking place in the vaporizer. The temperature oscillations corresponded with the heat being automatically cycled on and off, and the depletion and refill of the liquid reservoir in the vaporizer. It is believed that most of the moisture fluctuations were due to temperature and pressure variations within the vaporizer that influence the distribution of moisture between the liquid and gas phase ammonia. Evidence for the oscillating moisture levels is shown in FIG. 11 at 25 and 50 slpm, and a more detailed observation of this effect is shown in FIG. 12 at 50 slpm. FIG. 11 also shows that severe fluctuations in the water concentration occur as the flow rate is changed. It is believed that most of the fluctuations were due to temperature and pressure fluctuations within the vaporizer that influence the distribution of moisture between the liquid and gas phase ammonia. Additionally, it was apparent that the vaporizer was accumulating water in the liquid phase and periodically, the accumulated moisture was flash evaporated, resulting in large moisture spikes sent into the gas stream. This effect is clearly demonstrated in FIG. 13. The data in FIG. 13 show that at approximately 625 minutes a sharp spike in the water concentration was observed. This was due to the accumulated water in the liquid ammonia entering the gas phase within the vaporizer and subsequently entering the gas stream. Therefore, the water that was accumulating in the liquid phase ammonia from 200 minutes to 625 minutes was redistributed in to the gas phase in the time from 625 minutes to 675 minutes. This procedure and results simulates the effect of stopping flow of ammonia when using the conventional vaporizer.

Figure 14:
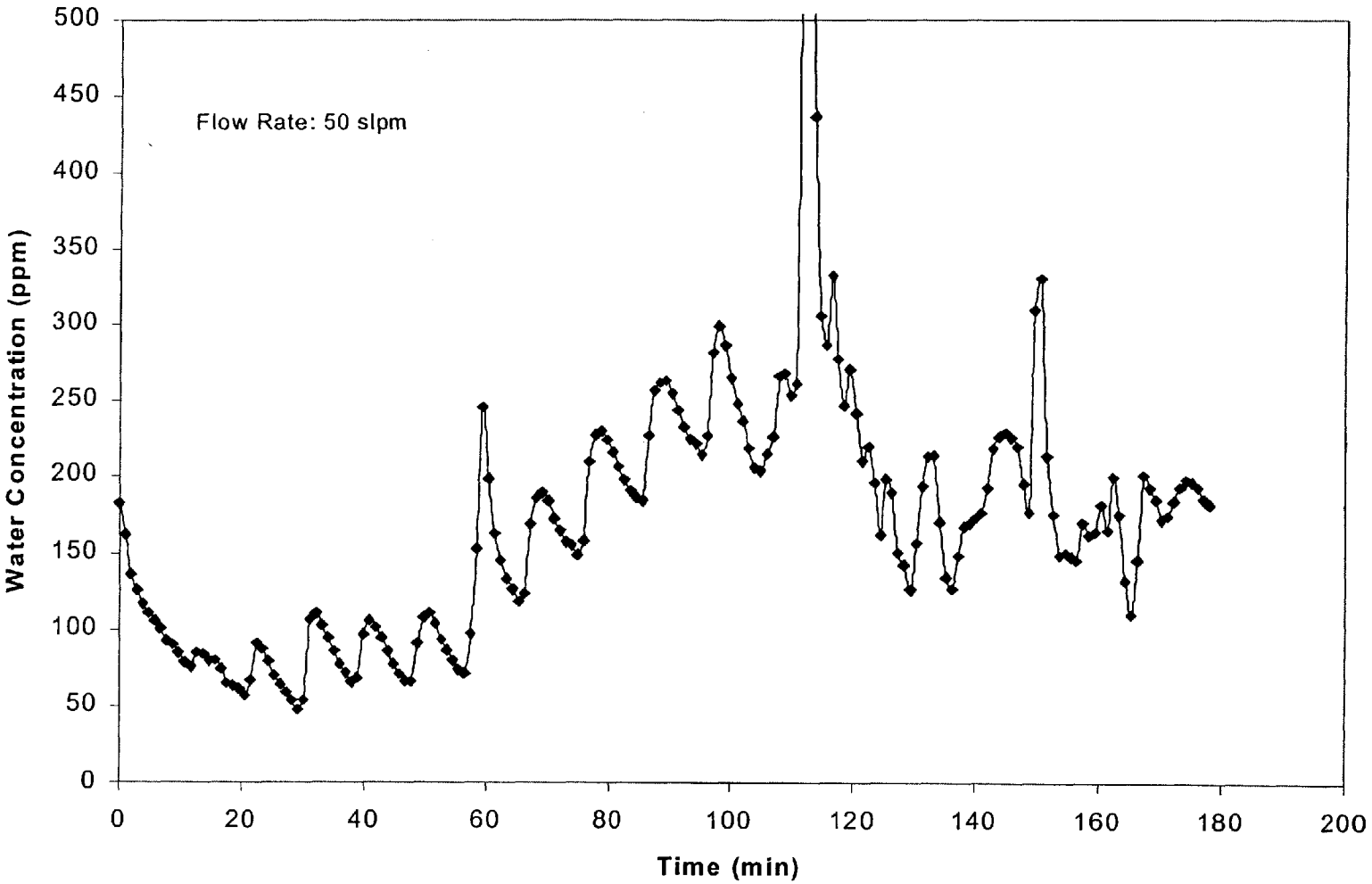
FIG. 14 is a graph plotting the change in water concentration in ammonia vaporized in a modified conventional pool-boiling type vaporizer at a flow rate of 50 slpm.
Figure 1:
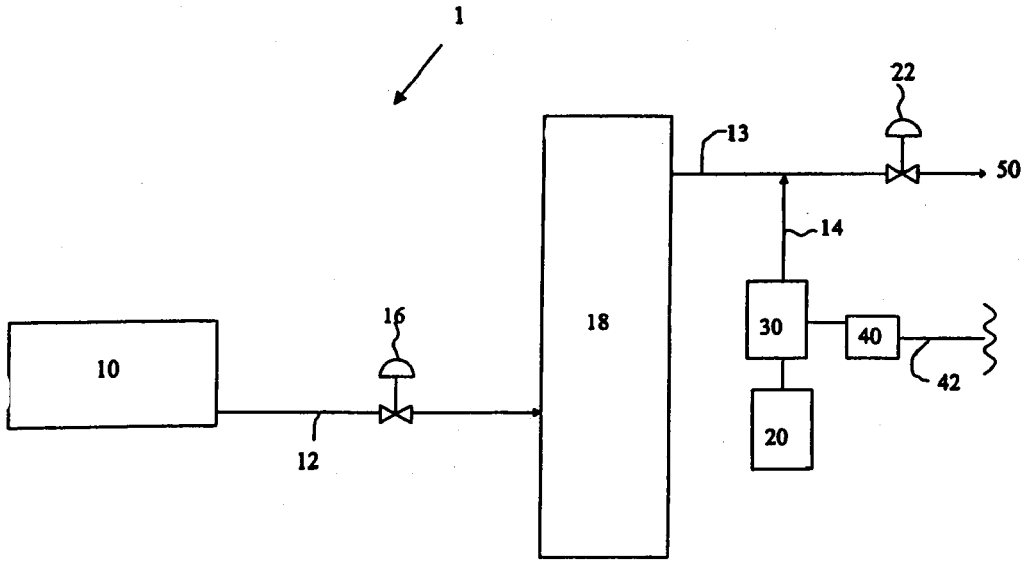
Figure 2:
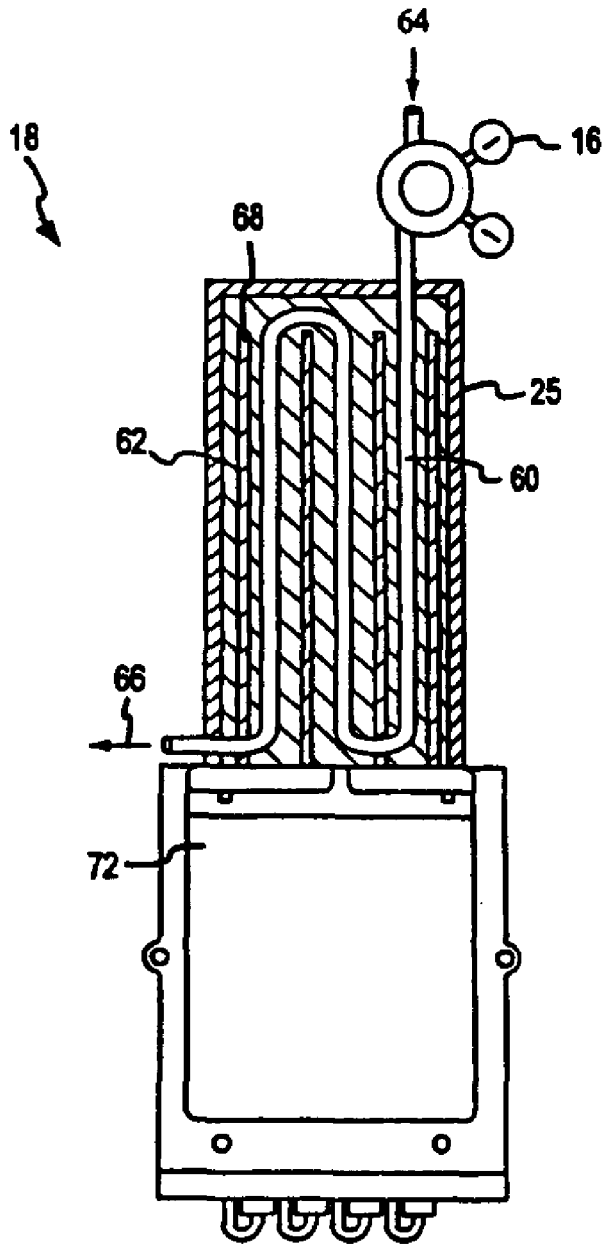
Figure 3:
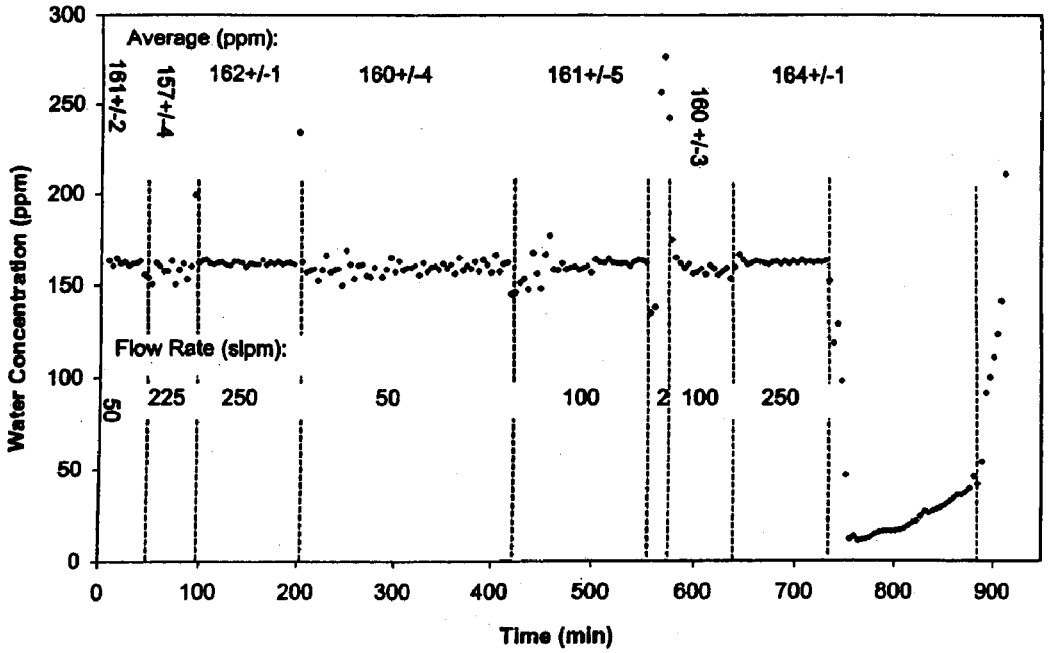
Figure 4:
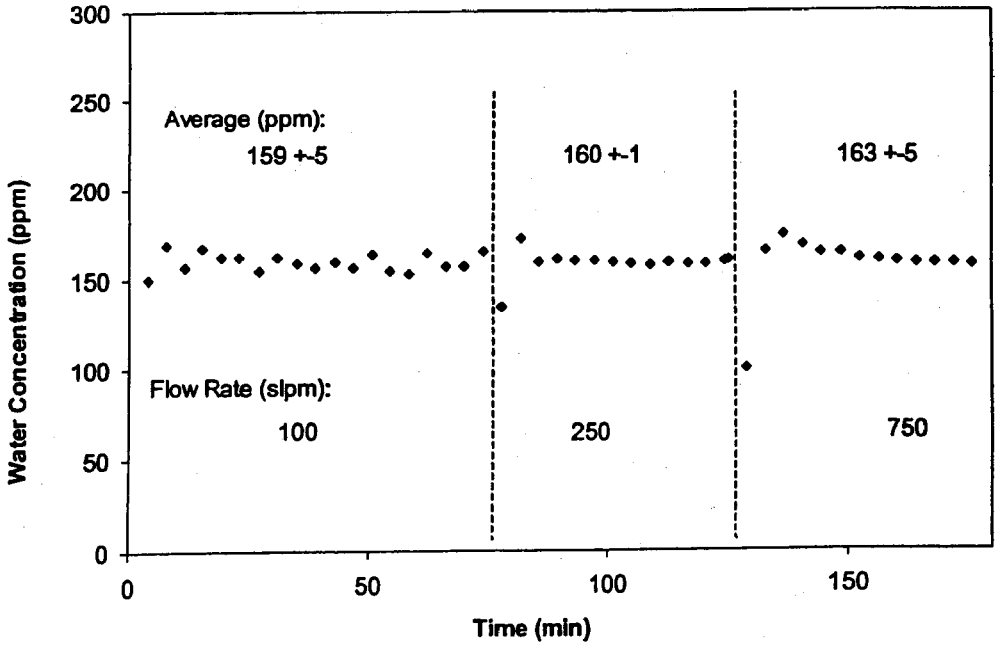
Figure 5:
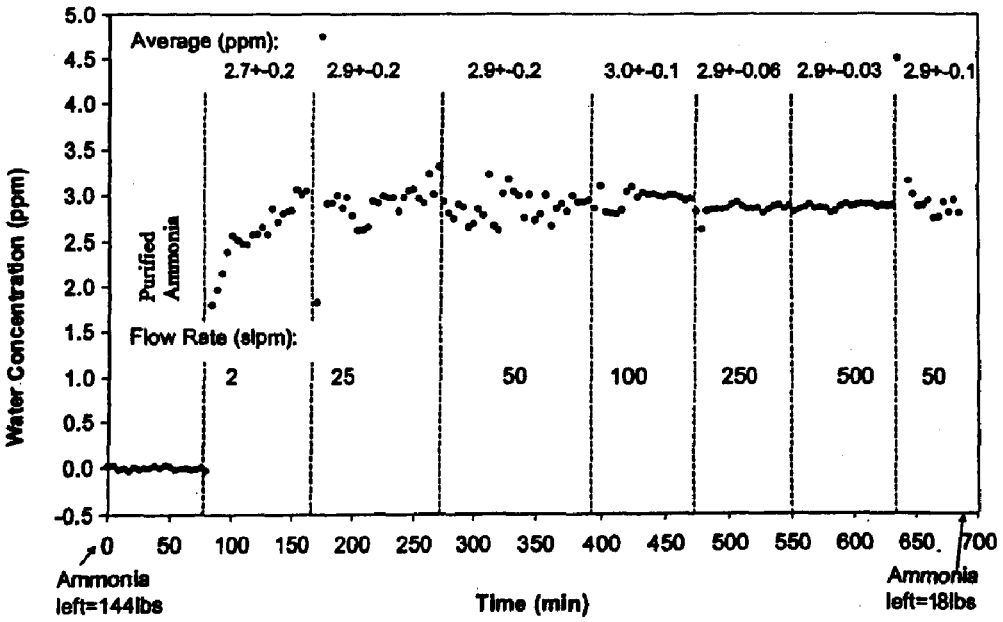
Figure 6:
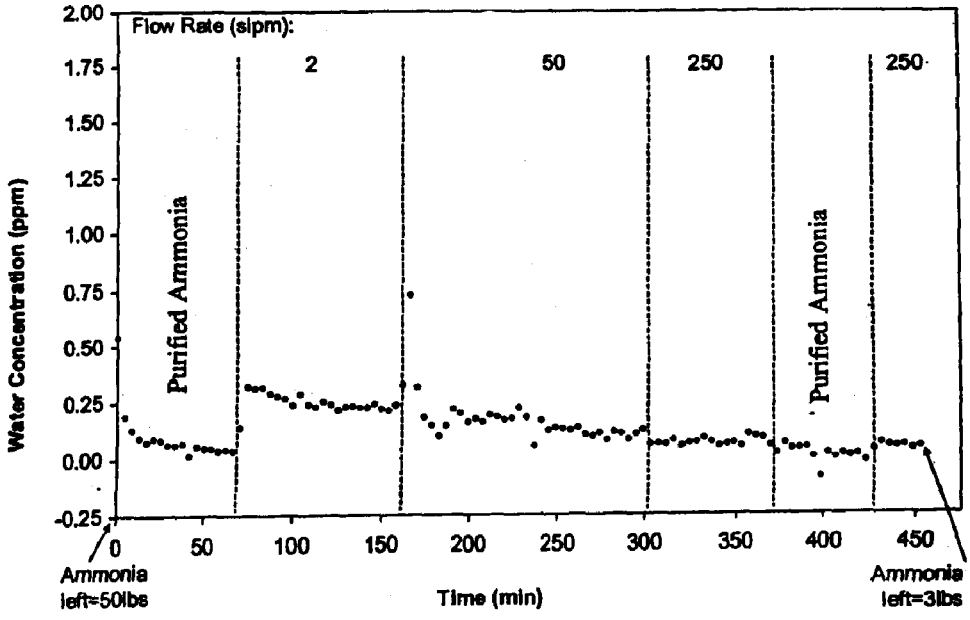
Figure 7:
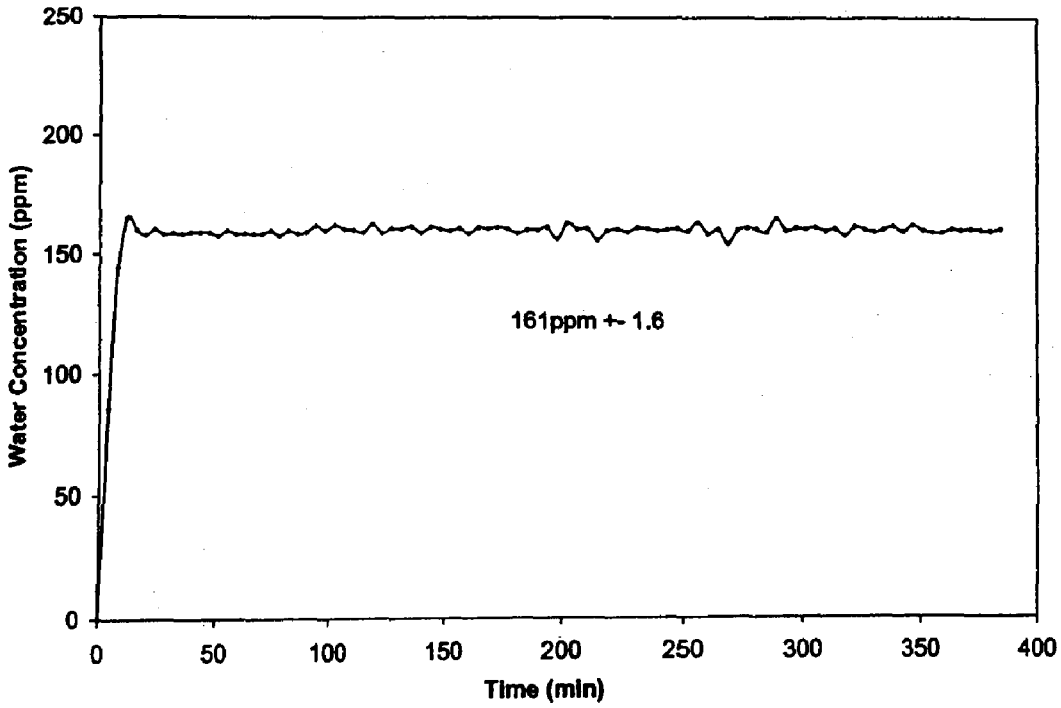
Figure 8:
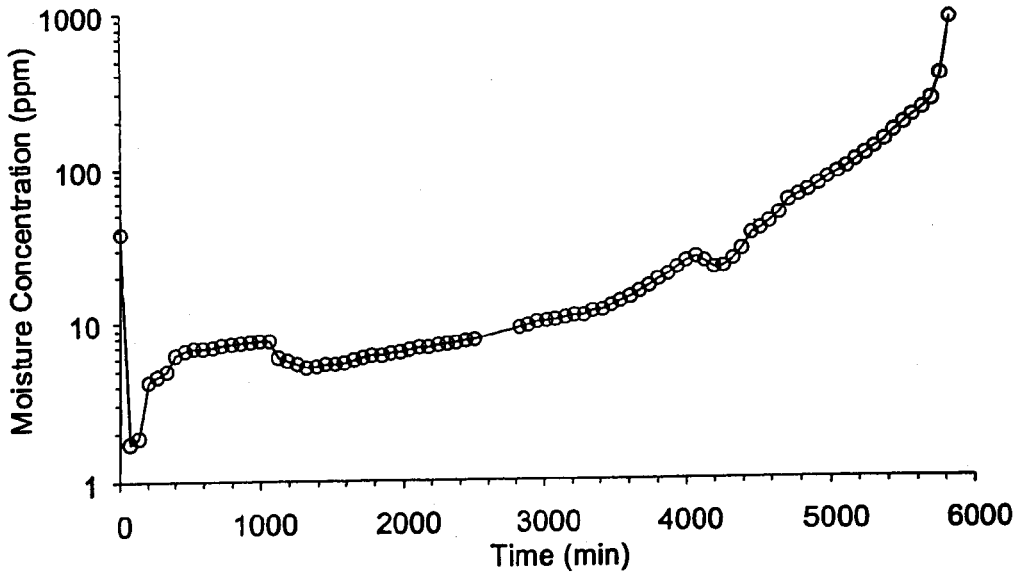
Figure 9:
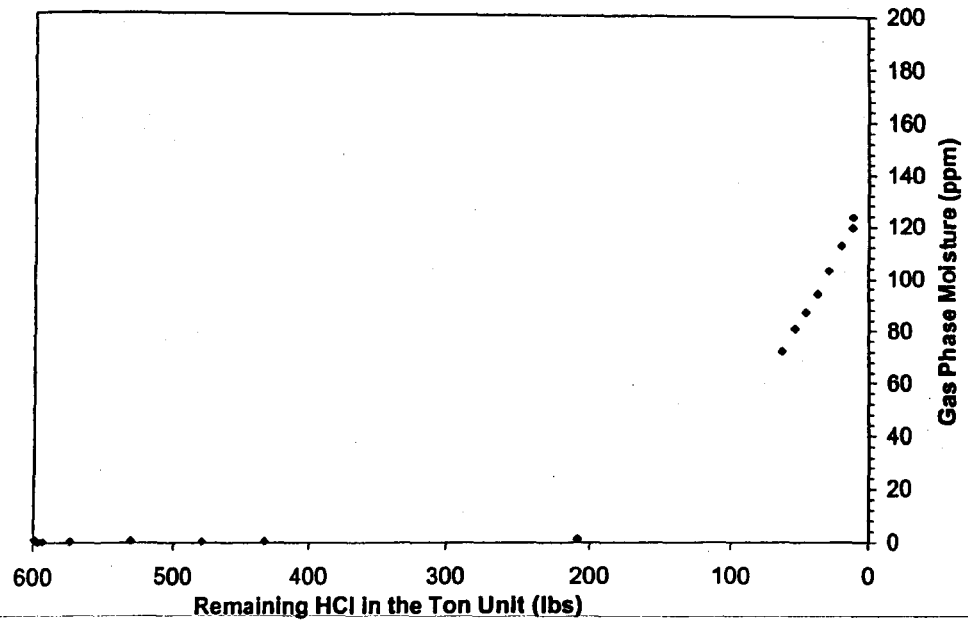
Figure 10:
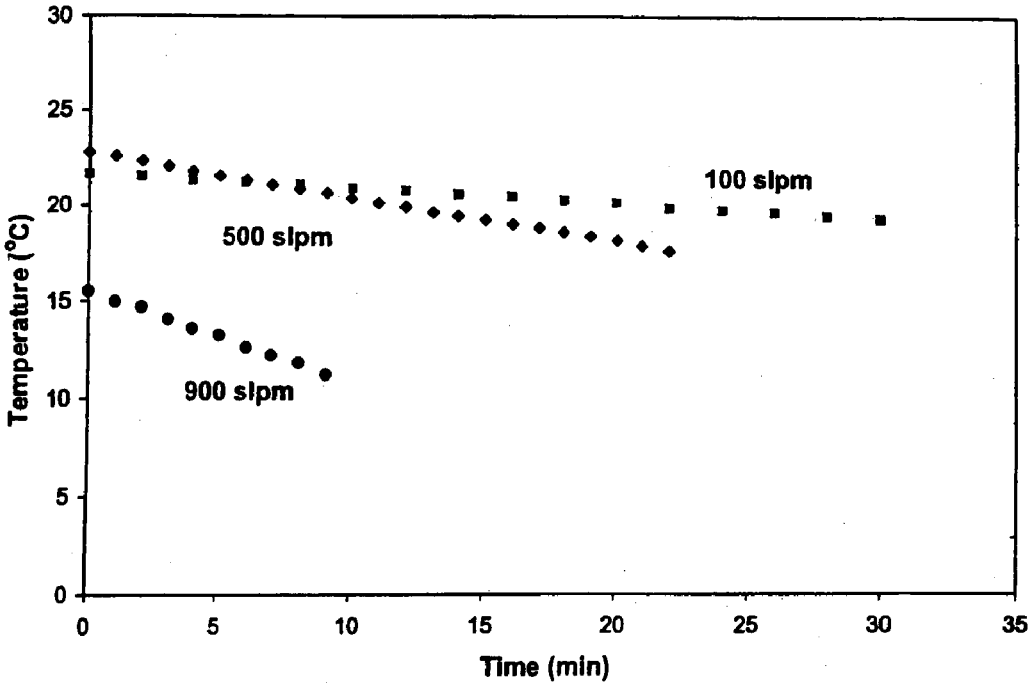
Figure 11:
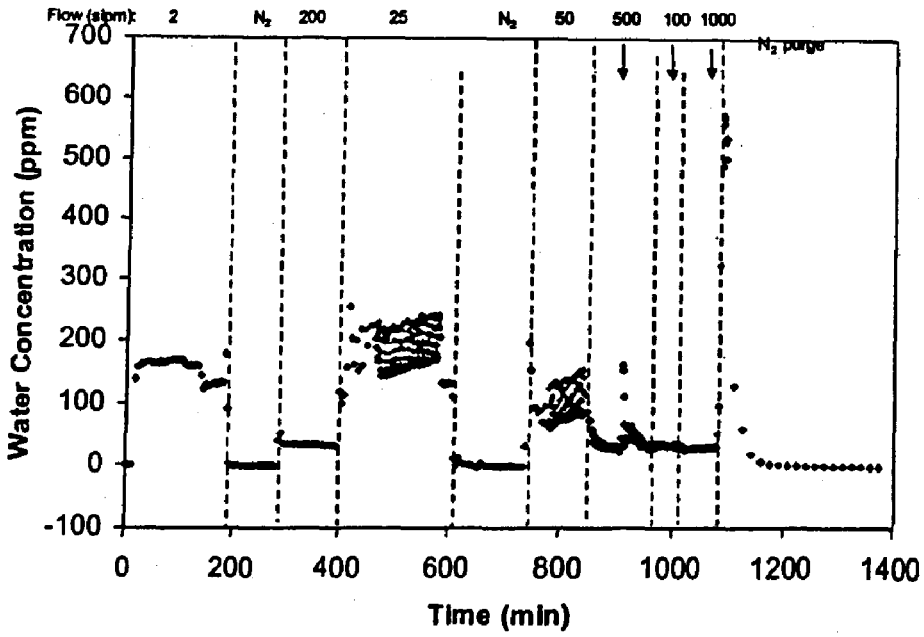
Figure 12:
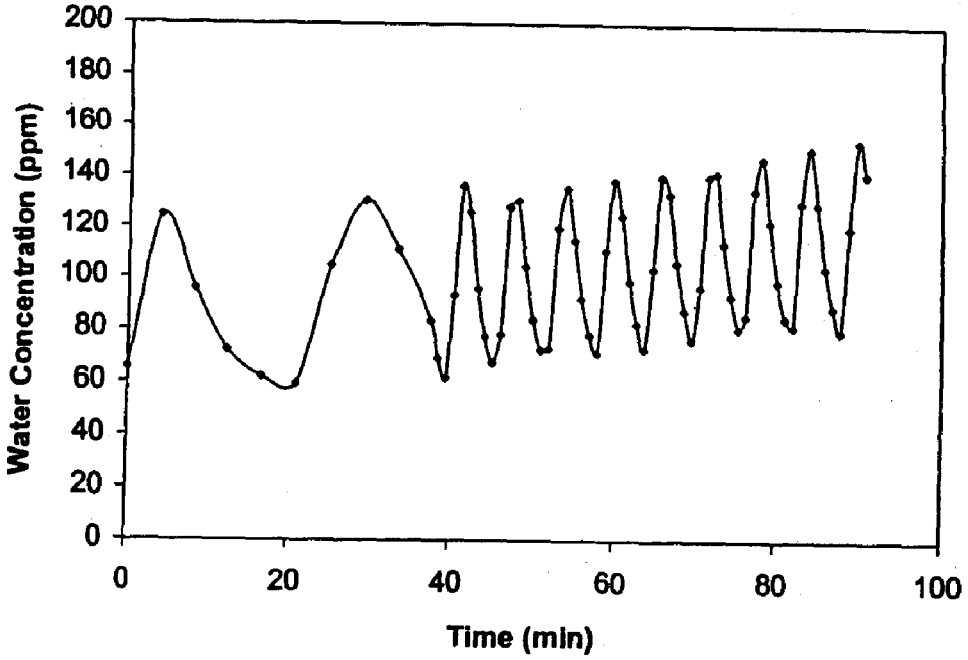
Figure 13:
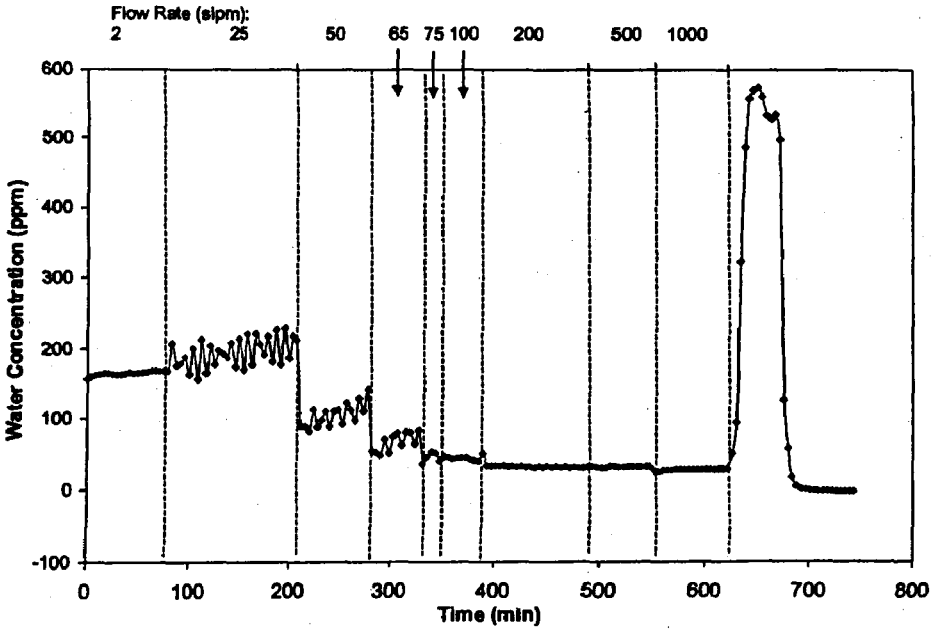

Modification of the conventional vaporizer was attempted in an effort to enhance the ability of the conventional vaporizer to operate in the capacity of a total vaporization system. Based on the design of the conventional vaporizer it was necessary to try to increase the surface area of the heating element that was submersed into the liquid ammonia. This was achieved by placing steel spheres within the vaporizing chamber. The steel spheres were in direct contact with the heating elements, and via direct thermal conduction acted as additional surface area for the vaporization of ammonia. It was estimated that the heated surface area of the vaporizer was increased by 71 percent by the addition of the steel spheres. FIG. 14 summarizes the results obtained after the modification of the surface area at a constant flow rate of 50 slpm. The results shown in FIG. 14 demonstrate that the moisture level was not constant at the relatively slow flow rate of 50 slpm. Although the vaporizer could be operated at approximately 25 slpm and achieve total vaporization, the effect of the steel spheres was not enough to have a significant impact on the performance of the conventional vaporizer. The results from these experiments indicated the conventional vaporizer could not be modified from the existing design in a manner that would allow for the operation as a total vaporizer. Although the vaporizer could be operated in total vaporization mode at slow flow rates, the flow rates demonstrating the desired effect were too low to be useful in a semiconductor manufacturing process. Furthermore, the vaporizer operated very inefficiently with respect to energy usage, since most of the heat being supplied to the vaporizer was not introduced into the liquid ammonia, but was being dissipated into the atmosphere and vapor stream as waste heat. Essentially, all the problems associated with moisture fluctuations when delivering from conventional gas phase delivery systems were now apparent in the conventional vaporizer liquid delivery system.

The words "comprise," "comprising," "include," "including," and "includes" when used in this specification and in the following claims are intended to specify the presence of one or more stated features, integers, components, or steps, but they do not preclude the presence or addition of one or more other features, integers, components, steps, or groups thereof. Furthermore, since a number of modifications and changes will readily occur to those skilled in the art, it is not desired to limit the invention to the exact construction and process shown described above. Accordingly, all suitable modifications and equivalents may be resorted to falling within the scope of the invention as defined by the claims that follow.

We claim:

1. A gas delivery system for delivering an initially liquefied form of a gas from at least one storage container to an endpoint, said system comprising:

a vaporization unit comprising an inlet, an outlet, a vaporizing means for converting said liquefied gas having a concentration of soluble impurities to the vapor phase, and a heating means for heating said vaporizing means to a temperature sufficient to completely vaporize said liquefied gas and soluble impurities, wherein said vaporizing means is capable of completely vaporizing said liquefied gas and said soluble impurities to form a vapor phase product before said liquefied gas and said soluble impurities accumulate in said vaporization unit, wherein the level of said impurities in said vapor phase product is substantially equivalent to the level of said impurities in said liquefied gas;

a first delivery conduit for delivering said liquefied gas from said at least one storage container to said vaporization unit; and a second delivery conduit for delivering said vapor phase product from said vaporization unit to said endpoint.

2. The delivery system of claim 1, wherein said first delivery conduit is adapted for fluidly connecting to said storage container.

3. The delivery system of claim 1, wherein said vaporizing means is selected from the group consisting of evaporators wherein the heating medium is separated from evaporating liquid by tubular heating surfaces, evaporators wherein the heating medium is confined by coils, jackets, double walls, or flat plates, evaporators wherein the heating medium is brought into direct contact with the evaporating liquid, and evaporators that are heated by solar radiation.

4. The delivery system of claim 3, wherein said vaporizing means is selected from the group consisting of tube side vaporizers, forced circulation evaporators, submerged-tube forced circulation evaporators, short-tube vertical evaporators, long-tube vertical evaporators, recirculating long-tube vertical evaporators, falling film evaporators, horizontal-tube evaporators, and hot plates.

5. The delivery system of claim 1, wherein said vaporizing means is a tube side vaporizer through which said liquefied gas and said soluble impurities flow and are completely vaporized.

6. The delivery system of claim 5, further comprising an in-tube vortex generator disposed within said tube side vaporizer.

7. The delivery system of claim 5, wherein said heating means is a heating block.

8. The delivery system of claim 1, further comprising a flow control device connected to said first delivery conduit for controlling the flow of said liquefied gas from said storage container to said vaporization unit.

9. The delivery system of claim 1, further a high temperature control mechanism operatively associated with said vaporization unit.

10. The delivery system of claim 1, further comprising a heating element for heating said heating means.

11. The delivery system of claim 10, wherein said heating element is selected from the group consisting of resistors, heating tape, heating jackets, hot water, steam tracing lines, or an encompassing convection oven.

12. The delivery system of claim 1, further comprising a purge system fluidly connected to said delivery system.

13. The delivery system of claim 12, further comprising a vacuum pump fluidly connected to said purge system.

14. The delivery system of claim 1, wherein said storage container is selected from the group consisting of a bubbler, a gas cylinder, a ton unit, a tube trailer, and a storage tank.

15. The delivery system of claim 1, comprising two or more storage containers fluidly connected to said first delivery conduit.

16. The delivery system of claim 1, further comprising one or more purification units.

17. The delivery system of claim 16, wherein at least one of said purification units is located between said liquid storage container and said vaporization unit.

18. The delivery system of claim 16, wherein at least one of said purification units is located downstream of said vaporization unit.

19. The delivery system of claim 1, wherein said endpoint is a semiconductor processing unit.

20. The delivery system of claim 1, wherein said endpoint is a gas purifier.

21. A method of delivering an initially liquefied form of a gas having a level of soluble impurities from a storage container to an endpoint, said gas having a substantially constant impurity level of said soluble impurities throughout said delivery, said method comprising:

(a) providing at least one source of said liquefied gas having said level of said soluble impurities;

(b) transporting said liquefied gas along with said soluble impurities to a vaporization unit via a first conduit;

(c) heating said liquefied gas and said soluble impurities to form a vapor phase product, wherein said liquefied gas and said soluble impurities are completely vaporized within said vaporization unit before said liquefied gas and said soluble impurities accumulate in said vaporization unit, and wherein the concentration of the vaporized form of said impurities in said vapor phase product is substantially equivalent to the concentration of said impurities in said liquefied gas; and (d) transporting said vapor phase product containing the vaporized form of said impurities from said vaporization unit to said endpoint via a second conduit.

22. The method of claim 21, wherein said vaporizing means is selected from the group consisting of evaporators wherein the heating medium is separated from evaporating liquid by tubular heating surfaces, evaporators wherein the heating medium is confined by coils, jackets, double walls, or flat plates, evaporators wherein the heating medium is brought into direct contact with the evaporating liquid, and evaporators that are heated by solar radiation.

23. The method of claim 22, wherein said vaporizing means is selected from the group consisting of tube side vaporizers, forced circulation evaporators, submerged-tube forced circulation evaporators, short-tube vertical evaporators, long-tube vertical evaporators, recirculating long-tube vertical evaporators, falling film evaporators, horizontal-tube evaporators, and hot plates.

24. The method of claim 21, wherein in said heating step is performed using a heating means disposed within said vaporization unit.

25. The method of claim 24, wherein said heating means is heated with a heating element selected from the group consisting of resistors, heating tape, heating jackets, hot water, steam tracing lines, or an encompassing convection oven.

26. The method of claim 21, wherein said vaporization unit comprises a tube side vaporizer.

27. The method of claim 26, further comprising heating said tube side vaporizer with a heating block.

28. The method of claim 21, wherein step (a) further comprises connecting said storage container to said first conduit.

29. The method of claim 21, further comprising purging said first and second conduits and said vaporization unit prior to step (a).

30. The method of claim 21, further comprising superheating said vapor phase product contained within said vaporization unit downstream of the point of vaporization.

31. The method of claim 30, further comprising insulating said second conduit prior to step (b).

32. The method of claim 21, wherein the flow of said liquefied gas into said vaporization unit is controlled with a flow control device connected to said first conduit.

33. The method of claim 21, wherein the flow of said liquefied gas into said vaporization unit is controlled by adjusting the temperature of said vaporization unit.

34. The method of claim 21, further comprising regulating the flow rate of said vapor phase product from said vaporization unit at a vapor phase flow rate of between about 0.001 slpm to about 10,000 slpm.

* * * * *

UNITED STATES PATENT AND TRADEMARK OFFICE

CERTIFICATE OF CORRECTION

PATENT NO. : 6,637,212 B2
DATED : October 28, 2003
INVENTOR(S) : Torres, Jr. et al.

It is certified that error appears in the above-identified patent and that said Letters Patent is hereby corrected as shown below:

The title page, showing an illustrative figure, should be deleted and substitute therefor the attached title page.

Delete figures 1-13, and substitute therefor the Figures, consisting of Figs. 1-13, as shown on the attached pages.

Signed and Sealed this

Thirty-first Day of August, 2004

JON W. DUDAS
*Director of the United States Patent and Trademark Office*

(12) United States Patent
Torres, Jr. et al.

(10) Patent No.: US 6,637,212 B2
(45) Date of Patent: Oct. 28, 2003

(54) METHOD AND APPARATUS FOR THE DELIVERY OF LIQUEFIED GASES HAVING CONSTANT IMPURITY LEVELS

(75) Inventors: Robert Torres, Jr., Parker, CO (US); Joseph V. Vininski, Denver, CO (US); Joseph Giagnacova, Harleysville, PA (US); Belgin Yucelen, Boulder, CO (US)

(73) Assignee: Matheson Tri-Gas, Longmont, CO (US)

( * ) Notice: Subject to any disclaimer, the term of this patent is extended or adjusted under 35 U.S.C. 154(b) by 0 days.

(21) Appl. No.: 10/128,992

(22) Filed: Apr. 24, 2002

(65) Prior Publication Data

US 2003/0010040 A1 Jan. 16, 2003

Related U.S. Application Data

(60) Provisional application No. 60/287,034, filed on Apr. 27, 2001.

(51) Int. Cl.[7] ..... F17C 9/02
(52) U.S. Cl. ..... 62/50.2
(58) Field of Search ..... 62/50.2, 50.4, 62/50.5

(56) References Cited

U.S. PATENT DOCUMENTS

| | | | | | |
|---|---|---|---|---|---|
| 3,969,449 | A | | 7/1976 | Shires et al. | 261/153 |
| 4,200,496 | A | | 4/1980 | Stein | 202/153 |
| 4,255,646 | A | * | 3/1981 | Dragoy et al. | 392/396 |
| 4,464,904 | A | | 8/1984 | Steigman | 62/52 |
| 4,847,469 | A | | 7/1989 | Hofmann et al. | 219/273 |
| 4,991,449 | A | * | 2/1991 | Dieguez | 73/863.11 |
| 5,107,906 | A | | 4/1992 | Swenson et al. | 141/11 |
| 5,252,134 | A | | 10/1993 | Stauffer | 118/726 |
| 5,329,777 | A | * | 7/1994 | Weltmer, Jr. | 62/49.2 |
| 5,337,738 | A | | 8/1994 | Heinonen | 128/203.12 |
| 5,386,707 | A | * | 2/1995 | Schulte et al. | 62/50.2 |
| 5,644,921 | A | | 7/1997 | Chowdhury | 62/48.1 |
| 5,762,119 | A | | 6/1998 | Platz et al. | 141/231 |
| 5,803,165 | A | * | 9/1998 | Shikazono et al. | 165/184 |
| 5,882,416 | A | | 3/1999 | Van Buskirk et al. | 118/726 |
| 5,894,742 | A | * | 4/1999 | Friedt | 62/50.2 |
| 6,032,483 | A | | 3/2000 | Paganessi et al. | 62/620 |
| 6,096,134 | A | | 8/2000 | Zhao et al. | 118/715 |

* cited by examiner

*Primary Examiner*—William C. Doerrler
(74) *Attorney, Agent, or Firm*—Steven C. Petersen; Sarah O'Rourke; Hogan & Hartson LLP

(57) ABSTRACT

A method and an apparatus are provided for the delivery of a vapor phase product having a substantially constant impurity level from a liquefied source of said gas to an endpoint. The delivery method includes withdrawing a liquefied gas having a level of impurities from a storage container and delivering the liquefied gas to a vaporization unit where the liquefied gas and the impurities dissolved therein are completely vaporized. The vapor phase product is then delivered to an endpoint. This invention affords the delivery of gases with substantially constant impurity levels throughout the delivery of the liquefied gas. In addition, this invention affords the delivery of the liquefied gas at high vapor phase flow rates for long periods of time and allows substantially complete usage of the contents of the storage container.

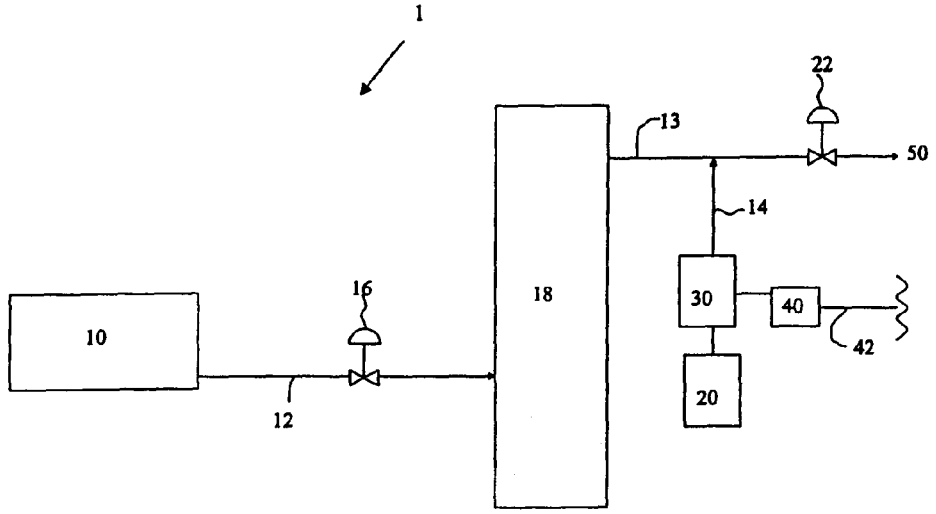

34 Claims, 14 Drawing Sheets